US006475046B2

(12) United States Patent
Muramatsu et al.

(10) Patent No.: US 6,475,046 B2
(45) Date of Patent: Nov. 5, 2002

(54) LUBRICATION SYSTEM FOR 4-CYCLE ENGINE OF SMALL WATERCRAFT

(75) Inventors: Hitoshi Muramatsu; Noboru Suganuma; Toshiaki Kasahara, all of Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/775,354

(22) Filed: Jan. 31, 2001

(65) Prior Publication Data

US 2001/0010988 A1 Aug. 2, 2001

(30) Foreign Application Priority Data

Jan. 31, 2000 (JP) ..... 2000-027302

(51) Int. Cl.[7] ..... B63H 21/10
(52) U.S. Cl. ..... 440/88; 123/195 C; 123/196 R
(58) Field of Search ..... 440/88, 89; 123/196 R, 123/572, 573, 574, 195 C; 184/106

(56) References Cited

U.S. PATENT DOCUMENTS

| | | | | | |
|---|---|---|---|---|---|
| 3,653,464 | A | * | 4/1972 | Jacobsen et al. | 184/106 |
| 4,449,493 | A | * | 5/1984 | Kopec et al. | 123/196 R |
| 5,058,545 | A | * | 10/1991 | Hirai et al. | 123/195 C |
| 5,103,782 | A | * | 4/1992 | Matsui | 123/195 C |
| 5,558,549 | A | | 9/1996 | Nakase et al. | 440/88 |
| 5,634,832 | A | | 6/1997 | Nakase et al. | 440/88 |
| 5,653,205 | A | * | 8/1997 | Ozeki | 123/196 R |
| 5,664,537 | A | * | 9/1997 | Beranek et al. | 123/195 C |
| 5,839,930 | A | | 11/1998 | Nanami et al. | 440/88 |
| 5,885,121 | A | | 3/1999 | Nanami et al. | 440/88 |
| 5,899,779 | A | | 5/1999 | Hattori | 440/88 |
| 5,951,343 | A | | 9/1999 | Nanami et al. | 440/88 |
| 5,957,072 | A | | 9/1999 | Hattori | 114/55.57 |
| 5,960,763 | A | * | 10/1999 | Yamamura | 184/106 |
| 5,960,908 | A | * | 10/1999 | Kasahara | 184/106 |
| 6,015,320 | A | | 1/2000 | Nanami | 440/88 |
| 6,029,638 | A | * | 2/2000 | Funai et al. | 123/572 |

FOREIGN PATENT DOCUMENTS

| | | |
|---|---|---|
| JP | 11-218016 | 8/1999 |
| JP | 3004917 | 11/1999 |

* cited by examiner

*Primary Examiner*—S. Joseph Morano
*Assistant Examiner*—Lars A. Olson
(74) *Attorney, Agent, or Firm*—Knobbe, Martens, Olson and Bear, LLP.

(57) ABSTRACT

A watercraft includes a lubrication system having a lubricant pump assembly and a lubrication reservoir defined between a lower crankcase member and an oil cover. At least one oil passage connects a crankcase to the reservoir. The oil cover, or both the oil cover and the crankcase member may contain one or more baffles configured to impede a flow of oil away from the lubricant pump assembly. Additionally, the cover may include one or more projections securing one or more plugs within one or more countersink portions of the crankcase member.

41 Claims, 16 Drawing Sheets

LUBRICATION SYSTEM FOR 4-CYCLE ENGINE OF SMALL WATERCRAFT

PRIORITY INFORMATION

The present application is based on and claims priority to Japanese Patent Application No. 2000-027,302, which was filed on Jan. 31, 2000, the entire contents of which are hereby expressly incorporated by reference.

BACKGROUND OF THE INVENTION

1. Field of the Invention

The present invention generally relates to a lubrication system of an internal combustion engine. More particularly, the present invention relates to a lubrication system of a small watercraft engine that powers a water propulsion device.

2. Description of Related Art

As personal watercraft have become popular, they have become increasingly fast. Today, personal watercrafts are capable of speeds greater than 60 mph. To attain such speeds, personal watercrafts are driven by high power output motors.

Typically, two-cycle engines are used in personal watercraft because two-cycle engines have a fairly high power to weight ratio. One disadvantage of two-cycle engines, however, is that they produce relatively high emissions. In particular, large amounts of carbon monoxide and hydrocarbons are produced during operation of the engine. When steps are taken to reduce these emissions, other undesirable consequences typically result, such as an increase in the weight of the engine, the cost of manufacture, and/or the reduction of power.

It has been suggested that four-cycle engines replace two-cycle engines in personal watercraft. Four-cycle engines typically produce less hydrocarbon emissions than two-cycle engines while still producing a relatively high power output. However, adapting four-cycle engines for use in personal watercraft has its own engineering and technical challenges due to, at least in part, the limited space available within the hull of a personal watercraft.

A four-cycle engine utilizes a more complex lubrication system as compared with a two-cycle engine. In a four-cycle engine, a reservoir of oil is held in an oil pan below the crankcase to be available for circulation by an oil pump. One approach to enabling the use of a four-cycle engine in personal watercraft applications is to provide the engine with a dry sump lubrication system. A dry sump system utilizes a shallow reservoir of oil available for the oil pump as compared with the volume of oil in a wet sump system having an oil pan, thus reducing the overall height of the engine. One drawback in a dry sump lubrication system is that rapid changes in acceleration of the watercraft may cause shifting of oil away from the oil pump inlet such that oil is temporarily unavailable for the oil pump. The occurrence of such a condition reduces the effectiveness of the lubrication system.

SUMMARY OF THE INVENTION

Thus, there exists a need for a dry sump lubrication system that ensures sufficient oil is readily available for the oil pump despite maneuvering of the watercraft.

Accordingly, in one aspect of the present invention, a watercraft comprises a hull defining an engine compartment.

An internal combustion engine is supported within the engine compartment. The engine includes an engine body, which defines at least one cylinder bore therein. The engine body additionally defines a crankcase having a crankshaft rotatably supported therein. At least one oil cover is connected to the engine body and defines an oil cavity between the oil cover and crankcase. At least one oil gallery is defined within the engine body. An oil pump is configured to circulate oil between the oil cavity and the oil gallery. The oil pump has an inlet configured to draw oil from the oil cavity at a position toward a rear end of the engine. The oil cover includes at least one baffle configured to impede a flow of oil in a forward direction away from the oil pump inlet.

According to another aspect of the present invention, an internal combustion engine includes an engine body that defines at least one cylinder bore therein. The engine body additionally defines a crankcase having a crankshaft rotatably supported therein. At least one oil cover is connected to the engine body and defines an oil cavity between the oil cover and the crankcase. At least one oil gallery is defined within the engine body. An oil pump is configured to circulate oil between the oil cavity and the oil gallery. The oil pump has an inlet configured to draw oil from the oil cavity. The oil cover includes at least one baffle configured to impede a flow of oil in a direction away from the oil pump inlet.

According to an additional aspect of the present invention a small watercraft is includes a hull defining an engine compartment. An internal combustion engine is supported within the engine compartment. The engine has an engine body which defines at least one cylinder bore therein. The engine body is comprised of at least a first and second member with the first and second member being connected by at least one bolt. The bolt has a bolt head disposed within a countersink portion of the engine body. A plug substantially sealing the bolt head is disposed at least partially within the countersink portion. An oil cover comprises at least one projection that is at least partially disposed above the plug.

Further objects, features and advantages of the present invention over the prior art will become apparent from the detailed description of the drawings which follows, when considered with the attached figures.

BRIEF DESCRIPTION OF THE DRAWINGS

The above-mentioned and other features of the invention will now be described with reference to the drawings of preferred embodiments of the present invention. The illustrated embodiments of the lubrication system, which are employed in an engine of a watercraft, are intended to illustrate, but not to limit, the invention. The drawings contain the following figures.

DETAILED DESCRIPTION OF THE PREFERRED EMBODIMENTS OF THE INVENTION

The present invention generally relates to an improved lubrication system having certain features and advantages in accordance with the present invention. The lubrication system is described in conjunction with a personal watercraft because this is an application in which the system has particular utility. Accordingly, an exemplary personal watercraft 10 will first be described in general detail to assist the reader's understanding of the environment of use. Of course, those of ordinary skill in the relevant arts will readily appreciate that the lubrication system described herein can also have utility in a wide variety of other environments, for example, without limitation, small jet boats and the like.

The small watercraft 10 and a corresponding engine 12 used in the small watercraft 10 will be described with initial reference to FIG. 14. The watercraft 10 is also described with reference to a coordinate system. The coordinate system includes a longitudinal axis that extends from the bow to the stem of the watercraft. The coordinate system further includes a lateral axis that extends from the port side to starboard side, in a direction generally normal to the longitudinal axis. Relative heights are expressed as elevations referenced to the undersurface of the watercraft. In addition, several of the figures include a label FR which is used to indicate the general direction in which the watercraft travels during normal forward operation.

Figure 1:
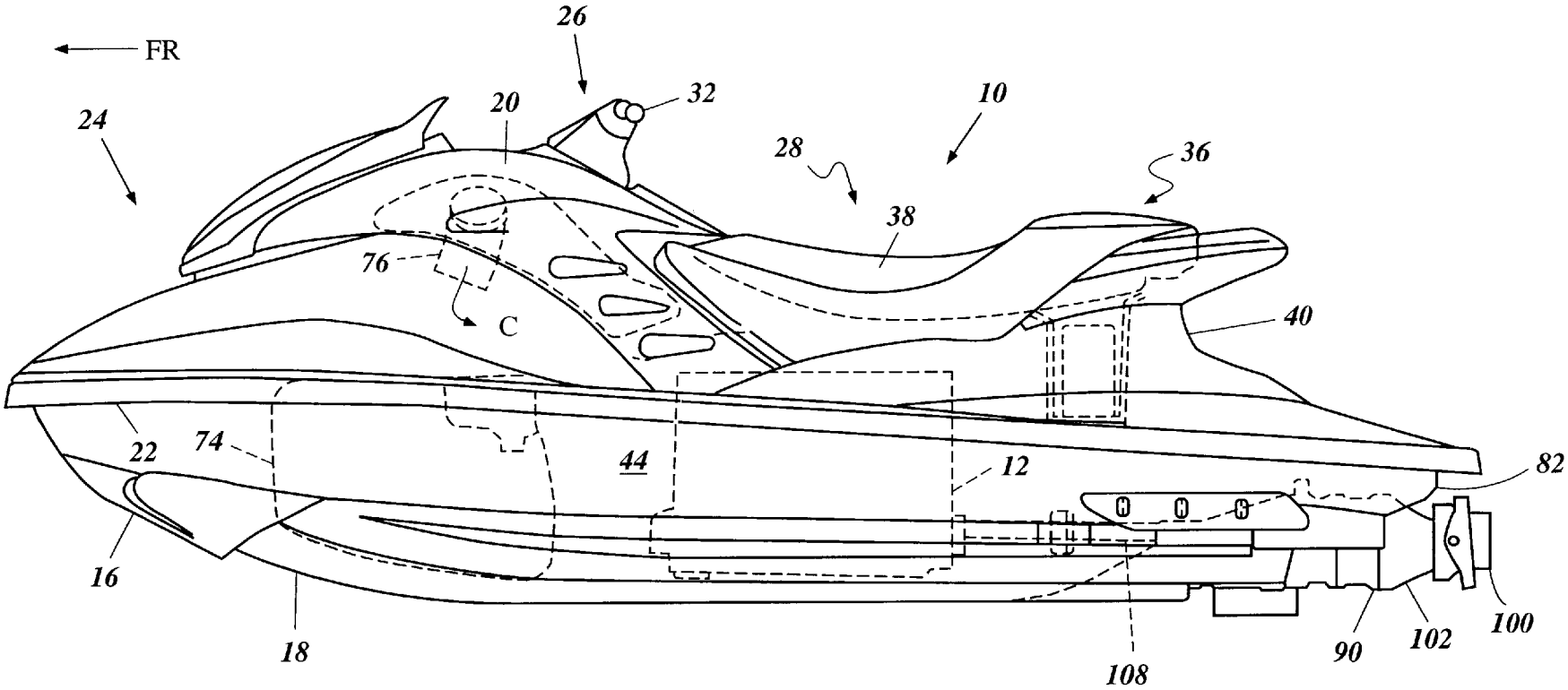
FIG. 1 is a side elevational view of a small watercraft with an engine and other certain internal components of the watercraft being illustrated with phantom lines.

With reference to FIG. 1, the watercraft 10 includes a hull 16 that is defined by a lower portion 18 and a top portion or "deck" 20. These portions of the hull 16 are preferably formed from a suitable material, such as, for example, a molded fiberglass reinforced resin. A bond flange 22 preferably connects the lower portion 18 to the deck 20. Of course, any other suitable means may be used to interconnect the lower portion 18 and the deck 20. Alternatively, the lower portion 18 and the deck 20 can be integrally formed.

As viewed in the direction from the bow to the stem, the deck 20 includes a bow portion 24, a control mast 26, and a rider's area 28. The control mast 26 supports a handlebar assembly 32. The handlebar assembly 32 controls the steering of the watercraft 10 in a conventional manner. The handlebar assembly 32 preferably carries a variety of controls for the watercraft 10, such as, for example, a throttle control (not shown), a start switch (not shown), and a lanyard switch (not shown). Additionally, a gauge assembly (not shown) is preferably mounted to the upper deck section 20 forward of the control mast 30. The gauge assembly can include a variety of gauges, such as, for example, a fuel gauge, a speedometer, an oil pressure gauge, a tachometer, and a battery voltage gauge.

The rider's area 28 lies rearward of the control mast 26 and includes a seat assembly 36. The illustrated seat assembly 36 includes at least one seat cushion 38 that is supported by a raised pedestal 40. The raised pedestal 40 forms a portion of the upper deck 20, and has an elongated shape that extends longitudinally substantially along the center of the watercraft 10. The seat cushion 38 desirably is removably attached to a top surface of the raised pedestal 40 by one or more latching mechanisms (not shown) and covers the entire upper end of the pedestal 40 for rider and passenger comfort.

An engine access opening is preferably located in the upper surface of the illustrated pedestal 40. The access opening opens into an engine compartment 44 formed within the hull 16. The seat cushion 38 normally covers and substantially seals the access opening to reduce the likelihood that water will enter the engine compartment 44. When the seat cushion 38 is removed, the engine compartment 44 is accessible through the access opening.

Figure 2:
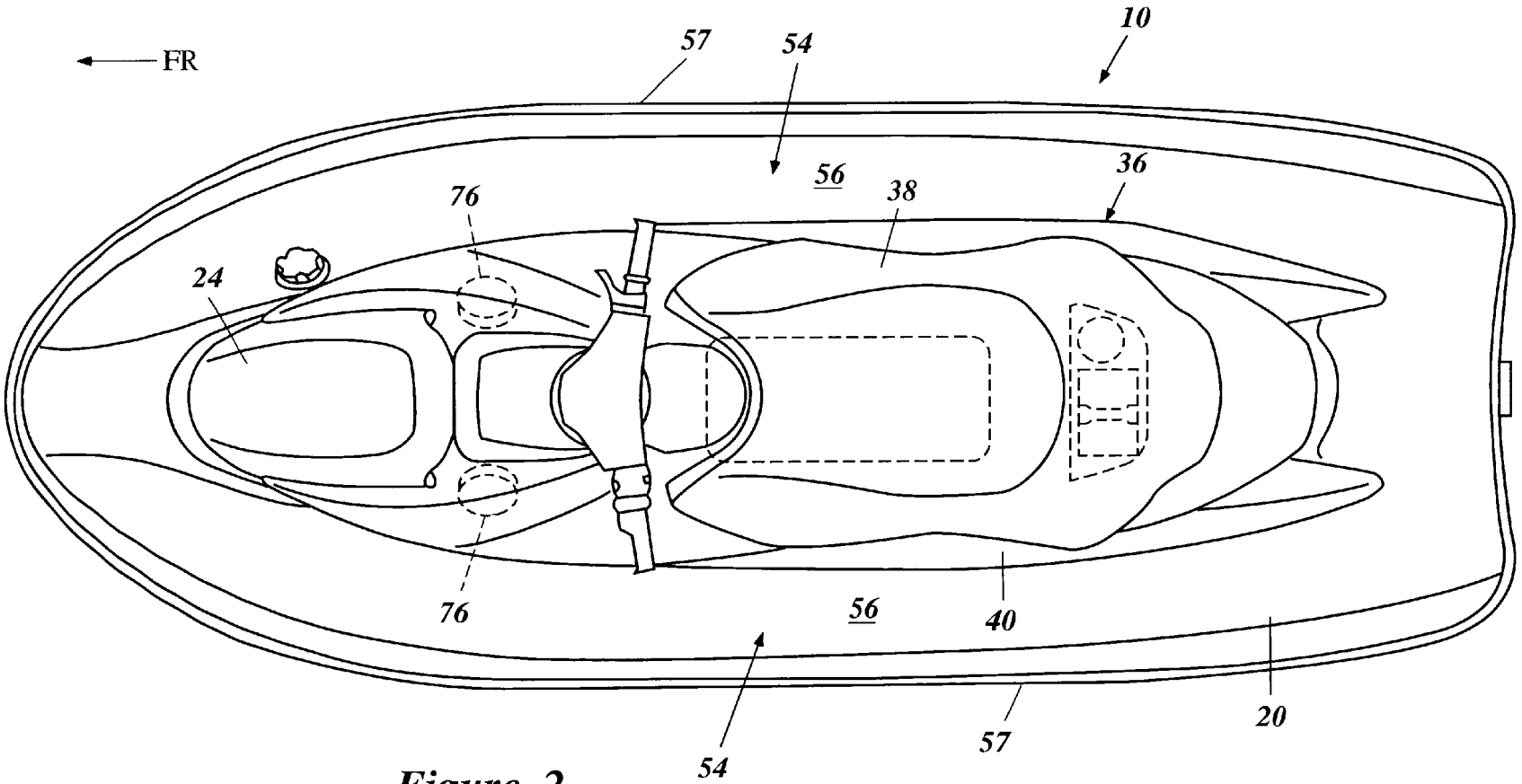
FIG. 2 is a top view of the watercraft with certain internal components of the watercraft being illustrated with phantom lines.

With reference to FIG. 2, the upper deck portion 20 of the hull 16 advantageously includes a pair of generally planar areas 54 positioned on opposite sides of the seat pedestal 40, which define foot areas 56. The foot areas 56 extend generally along and parallel to the sides of the pedestal 40 and are substantially enclosed on the lateral sides by the pedestal 40 and a raised gunnel 57. In this position, the operator and any passengers sitting on the seat assembly 36 can place their feet on the foot areas 56 during normal operation of the watercraft 10 with their feet generally protected from water passing along the sides of the moving watercraft. A nonslip (e.g., rubber) mat desirably covers the foot areas 56 to provide increased grip and traction for the operator and passengers.

The interior of the hull 16 includes one or more bulkheads (not shown) that can be used to reinforce the hull 16 internally and that also can serve to define, in part, the engine compartment 44 and a propulsion compartment, which is arranged generally rearward from the engine compartment 44. The engine 12 is mounted within the engine compartment 44 in any suitable manner preferably at a central transverse position of the watercraft 10.

With reference to FIG. 1, a fuel tank 74 preferably is arranged forwardly from the engine 12 and is suitably secured to the hull 16 of the watercraft 10. A fuel filler tube (not shown) preferably extends between the fuel tank 74 and the upper deck 20, thus allowing the fuel tank 74 to be filled with fuel via the tube.

A forward air duct 76 extends through the upper deck portion 20. The forward air duct 76 allows atmospheric air C to enter and exit the engine compartment 44. Similarly, a rear air duct (not shown) extends through an upper surface of the seat pedestal 40, preferably beneath the seat cushion 38, thus also allowing atmospheric air C to enter and exit the engine compartment 44. Air may pass through the air ducts 76 in both directions (i.e., into and out of the engine compartment 44). Except for the air ducts 76, the engine compartment 44 is substantially sealed so as to protect the engine 12 from the body of water in which the watercraft 10 is operated.

The lower hull section 18 is designed such that the watercraft 10 planes or rides on a minimum surface area of the aft end of the lower hull section 18 in order to optimize the speed and handling of the watercraft 10 by reducing the wetted surface area, and therefore the drag associated with that surface area. For this purpose the lower hull section 18 has a generally V-shaped configuration formed by a pair of inclined sections that extend outwardly from a keel line to outer chines at a dead rise angle. The inclined sections extend longitudinally from the bow 24 toward the transom 82 (see FIG. 1) of the lower hull section 18 and extend outwardly to sidewalls of the lower hull section 18. The sidewalls are generally flat and straight near the stem of the lower hull section 18 and smoothly blend towards a longitudinal center of the watercraft 10 at the bow. The lines of intersection between the inclined sections and the corresponding sidewalls form the outer chines, which affect handling, as known in the art.

A jet pump unit 90 propels the watercraft 10. The jet pump unit 90 includes an impeller (not shown) rotatably mounted within an impeller housing 98. The jet pump unit 90 is mounted within a tunnel formed on the underside of the lower hull section. An intake duct, defined by the hull tunnel, extends between the jet pump unit 90 and an inlet opening that opens into a gullet.

A steering nozzle 100 is supported at the downstream end of a discharge nozzle 102 of the impeller housing 98 by a pair of vertically extending pivot pins (not shown). In an exemplary embodiment, the steering nozzle 100 has an integral lever on one side that is coupled to the handlebar assembly 32 through, for example, a bowden-wire actuator, as known in the art. In this manner, the operator of the watercraft 10 can move the steering nozzle 100 to effect directional changes of the watercraft 100.

An impeller shaft 108 supports the impeller within the impeller housing 98. The aft end of the impeller shaft 108 is suitably supported and journaled within a compression chamber of the housing 98 in a known manner. The impeller shaft 108 extends in a forward direction through the bulkhead. The forward end of the impeller shaft 108 is connected to the engine 12.

The engine 12, which drives the jet pump unit 90, will now be described with initial reference to FIG. 3. The illustrated engine 12 is a four-stroke, in-line straight four cylinder engine. However, it should be appreciated that several features and advantages of the present invention can be achieved utilizing an engine with a different cylinder configuration (e.g., v-type, w-type or opposed), a different number of cylinders and/or a different principle of operation (e.g., two-cycle, rotary, or diesel principles).

The engine 12 comprises an engine body 112 having a cylinder head 114, a cylinder block 116 and a crankcase member 118. The crankcase member 118 defines a crankcase chamber 119. The cylinder block 116 preferably is formed with four generally vertically extending cylinder bores. The cylinder bores may be formed from thin liners that are either cast or otherwise secured in place within the cylinder block 116. Alternatively, the cylinder bores 120 may be formed directly in the base material of the cylinder block 116. If a light alloy casting is employed for the cylinder block 116, such liners preferably are used.

As mentioned above, the illustrated engine 12 is a four cylinder engine; thus, the cylinder block 116 includes four cylinder bores 120. A piston is provided within each cylinder bore 120 and is supported for reciprocal movement therein. The pistons are connected to respective connecting rods. The connecting rods are journaled on the throws of a crankshaft 128. The crankshaft 128 is journaled by a plurality of bearings within the crankcase chamber 119 to rotate about a crankshaft axis that lies generally parallel to the longitudinal axis of the watercraft 10. As will be explained in more detail below, the crankcase member 118 preferably comprises an upper crankcase member 130 and a lower crankcase member 132, which are attached to each other in any suitable manner.

The cylinder head 114 is provided with individual recesses that cooperate with the respective cylinder bores 120 and the heads of the pistons to form combustion chambers. These recesses are surrounded by a lower cylinder head surface that is generally planar and that is held in sealing engagement with the cylinder block 116, or with cylinder head gaskets (not shown) interposed therebetween, in a known manner. The cylinder head 114 may be affixed to the cylinder block 116 in any suitable manner.

Poppet-type intake valves are slideably supported in the cylinder head 114 in a known manner, and have their head portions engageable with valve seats so as to control the flow of the intake charge into the combustion chambers through intake passages formed in the cylinder head 114. The intake valves are biased toward their closed position by coil compression springs. The valves are operated by an intake camshaft which is suitably journaled in the cylinder head 114 in a known manner. The intake camshaft has lobes that operate the intake valves through thimble tappets.

The intake camshaft is driven by the crankshaft 128 via a camshaft drive mechanism. The camshaft drive mechanism is well known in the art; thus, a further description of this mechanism is not necessary for one of ordinary skill in the art to practice the present invention.

The cylinder head 114 includes at least one exhaust passage for each combustion chamber. The exhaust passages emanate from one or more valve seats formed in the cylinder head 114. At least one exhaust valve is supported for reciprocation in the cylinder head 114 for each combustion chamber, in a manner similar to the intake valves. The exhaust valves also are biased toward their closed position by coiled compression springs. An overhead mounted exhaust camshaft opens and closes the exhaust valves. As with the intake camshaft, the exhaust camshaft is suitably journaled for rotation in the cylinder head 114 and includes cam lobes that cooperate with thimble tappets for operating the exhaust valves in a known manner. In the illustrated engine, the rotational axis of the intake camshaft and the exhaust camshaft are parallel to each other. Like the intake camshaft, the crankshaft 128 drives the exhaust camshaft in a known manner.

A suitable ignition system is provided for igniting an air and fuel mixture that is provided to each combustion chamber. Spark plugs preferably are fired by a suitable ignition system, which may include an electronic control unit (ECU) connected to the engine 12 by one or more electrical cables. A pulsar-coil (not shown), which may be incorporated into the ECU, generates firing signals for the ignition system. In addition, the ignition system may include a battery for use in providing power to an electric starter and the like. The crankshaft 128 is preferably coupled to a flywheel assembly, which preferably is located in front of the engine 12. The flywheel assembly includes a flywheel magneto that forms part of the ignition system. A cover 158 is attached to the front end of the cylinder block 116 and cylinder head 114 to enclose the flywheel assembly .

The engine also includes an air intake system 160 for providing air to the combustion chambers. With reference to FIG. 3, the illustrated engine air intake system 160 includes intake pipes 162 that communicate with the intake passages formed in the cylinder head 114. The intake pipes 162 extend generally downwardly from the cylinder head 114 and communicate with an intake chamber 164, which preferably is positioned entirely lower than the cylinder head 114. The intake chamber 164 is positioned generally below the intake pipes 162 and along a side of the engine 12.

The watercraft 10 also includes a fuel supply system that delivers fuel to the engine 12. The fuel supply system preferably includes a low pressure pump, a vapor separator, a high pressure pump and a charge forming device. The fuel supply system also includes the fuel tank 74, which is shown schematically in FIG. 1. The low pressure pump draws fuel from the fuel tank 74 and supplies fuel to the vapor separator. The vapor separator separates vapor from the fuel. The high pressure pump then delivers fuel to the charge forming device. The charge forming device introduces a fuel charge into the air from the air intake system. The intake valves then open to allow the air and fuel charge into the combustion chamber to be ignited in a known manner.

The watercraft 10 also includes an engine exhaust system for guiding exhaust gases produced by the engine 12 to the atmosphere. The engine exhaust system includes a plurality of exhaust passages which communicate respectively with the combustion chambers that are formed within the engine 12, and an exhaust manifold that communicates with each of the exhaust passages. An exhaust pipe is connected to the exhaust manifold and is, in turn, connected to an expansion chamber configured to attenuate the noise carried by the flow of exhaust gases, in a known manner. The expansion chamber and the exhaust pipe preferably include cooling passages that are connected to a cooling system by a coolant pipe. The cooling system cools the exhaust gases, the exhaust pipe, and the expansion chamber in a known manner. The expansion chamber communicates with a water lock. The water lock is a well-known device that allows exhaust gases to pass, but contains a number of baffles that prevent water from passing back through the exhaust pipe and the expansion chamber and into the engine 12. The water lock transfers exhaust gases to a discharge pipe which then releases the exhaust gases to a discharge formed on the hull tunnel.

The watercraft 10 also includes a dry sump-type lubrication system for lubricating various components of the engine 12, illustrated in FIGS. 3–17. Under the dry-sump lubrication principle, lubricant is circulated through the engine 12 using a shallow lubricant reservoir and allowing the engine 12 to be mounted close to an inner surface of the lower hull section 18, as compared to engines employing wet sump type lubrication systems. This lowers the center of gravity of the watercraft 10. Of course, certain features, aspects and advantages of the present invention can be used in wet sump operations.

In operation, oil is drawn from the shallow reservoir 286 and pumped through a vapor separator, to various parts of the engine 12, then returns to the shallow oil reservoir 286. The cycle preferably is repeated continuously to provide lubrication to desired parts of the engine 12.

Figure 3:
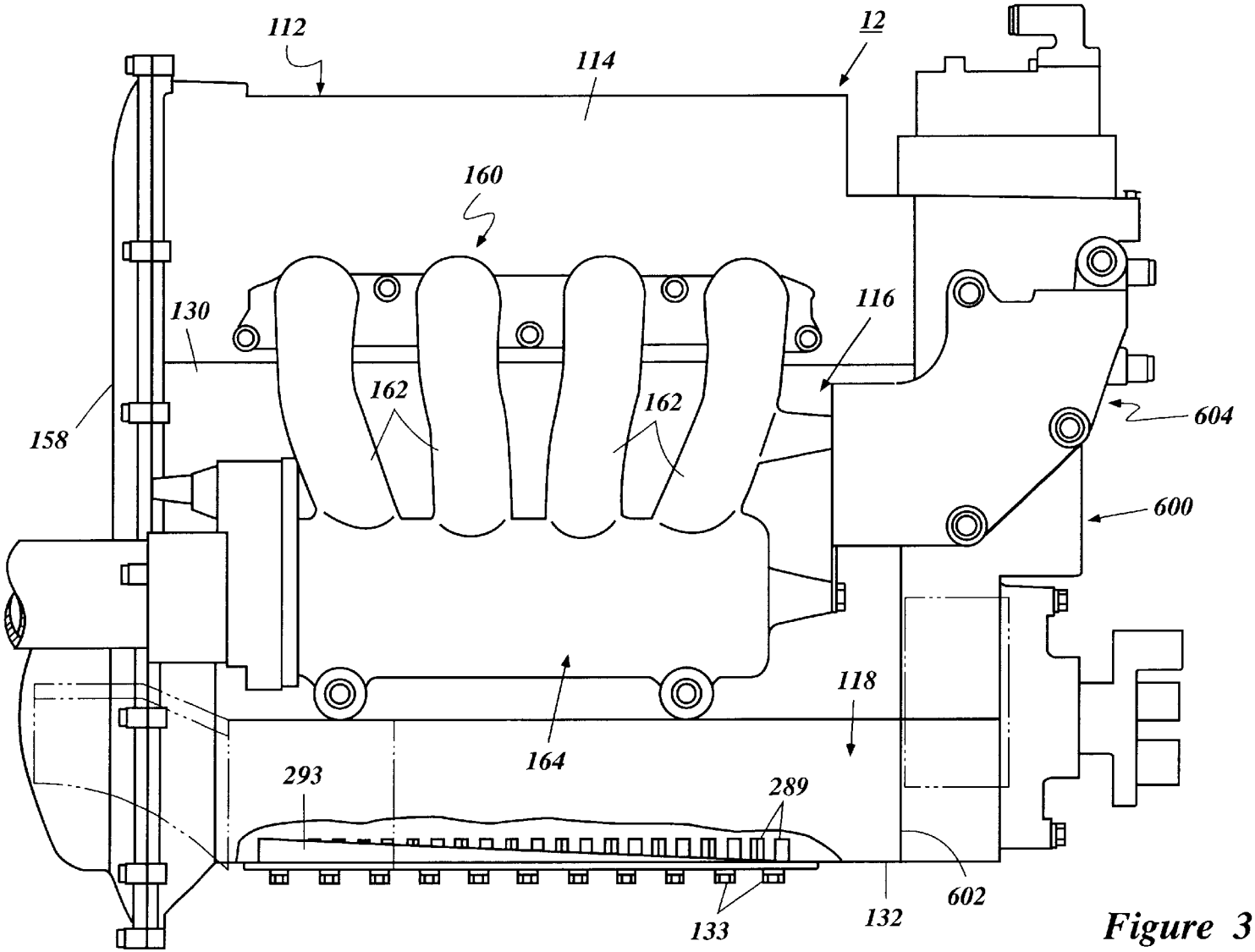
FIG. 3 is an enlarged port side view of the engine with a lower portion of the engine shown in cut away view.
Figure 7:
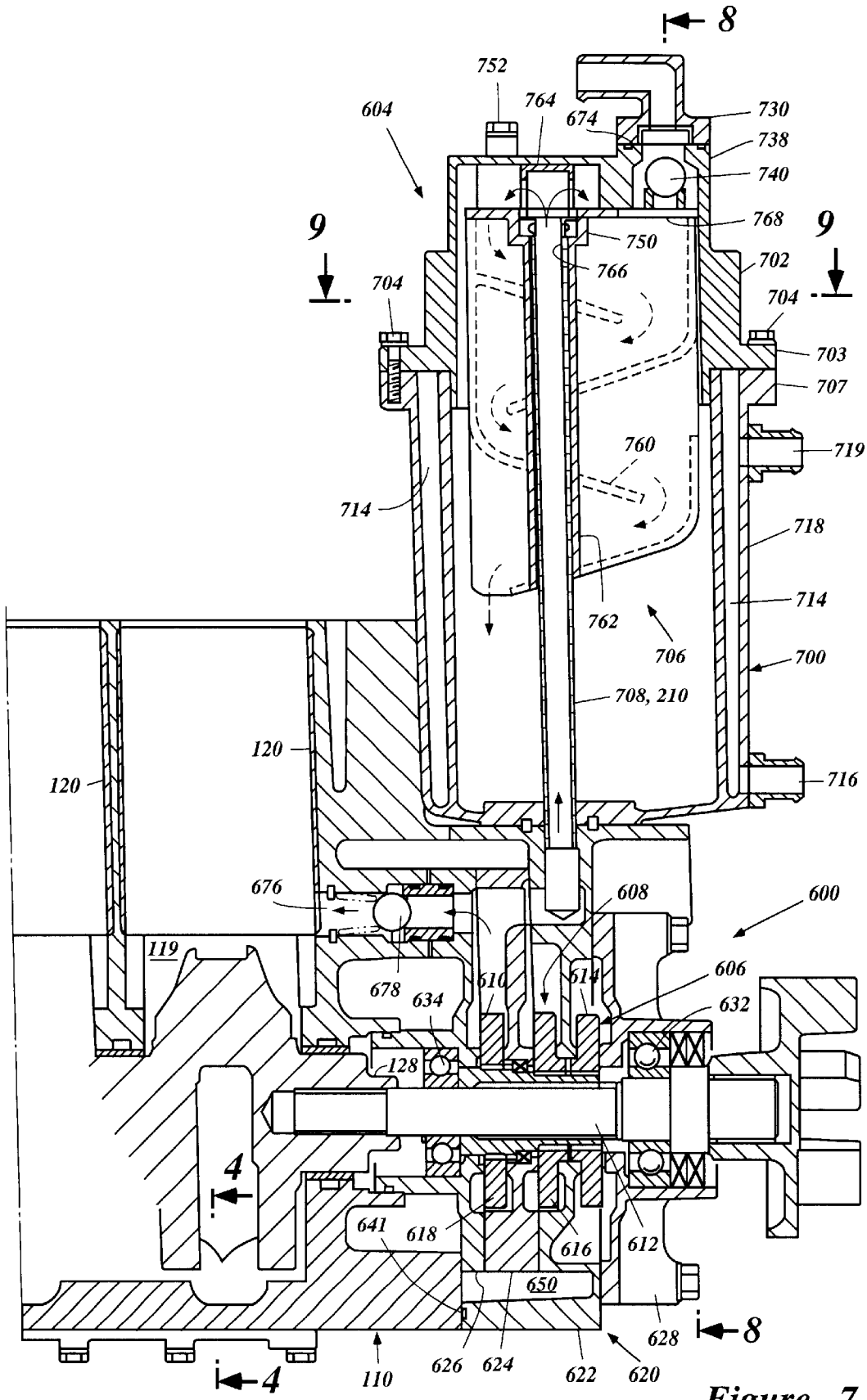
FIG. 7 is a cross-sectional view of a rear portion of the engine including an oil vapor separator and an oil pump.
Figure 8:
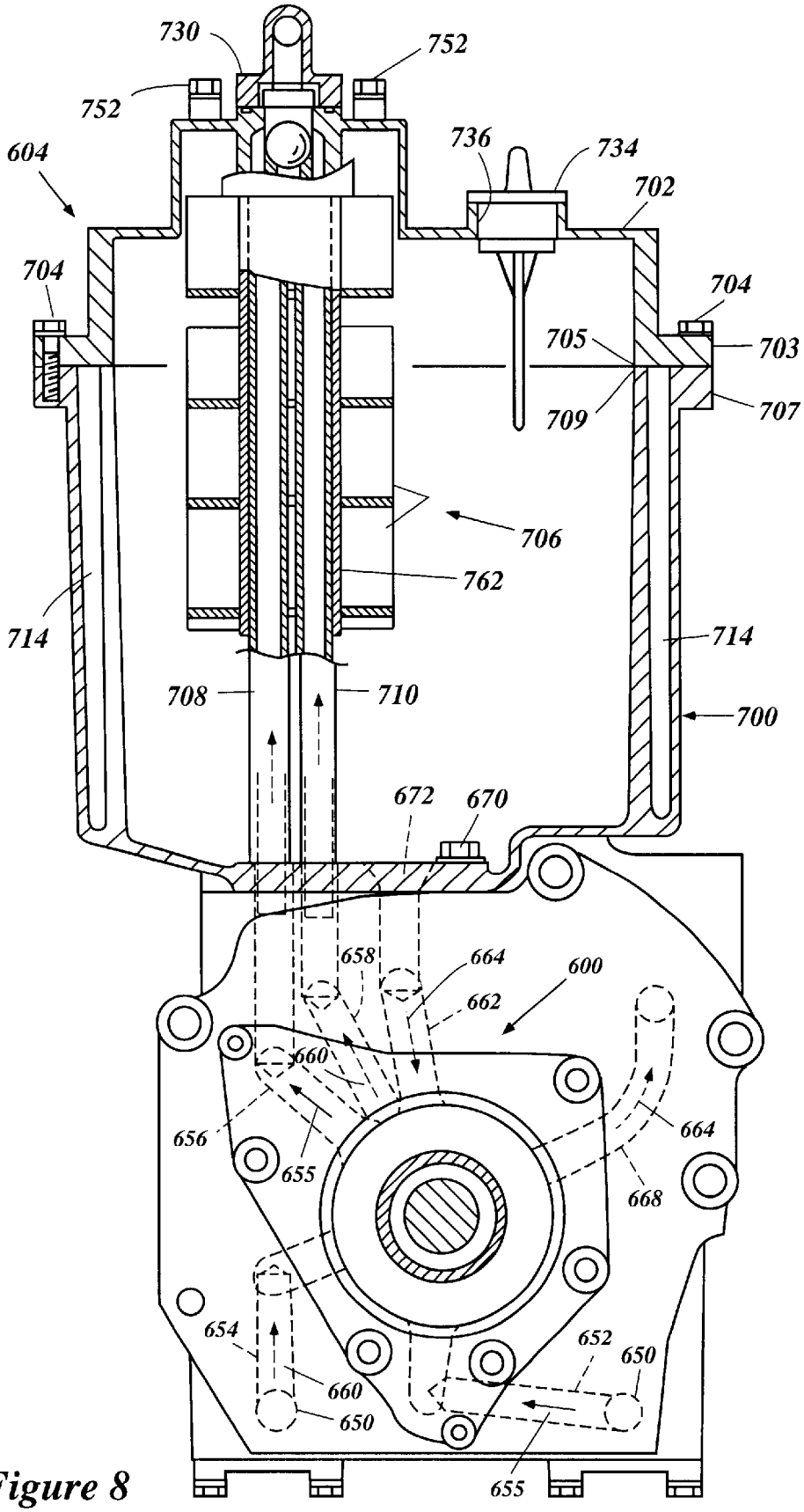
FIG. 8 is a cross-sectional view of the oil pump and vapor separator taken along section line 8—8 of FIG. 7.

With reference to FIGS. 3 and 7–8, a pump unit 600 is mounted at a rear surface 602 of the crankcase member 118. An oil tank 604, which is preferably made of an aluminum alloy is mounted above the pump unit 600. As best seen in FIG. 7, the pump unit 600 is comprised of a first suction pump 606, a second suction pump 608 and a lubricant transfer pump 610. Each of the pumps, 606, 608, 610 are generally axially aligned and are journaled to a pump shaft 612, which is splined to the rear of and co-axial with the crankshaft 128. In the illustrated arrangement, the first suction pump 606 is situated furthest from the crankshaft 128 and the lubricant transfer pump 610 is situated closest to the crankshaft 128. The second suction pump 608 is located between the first suction pump 606 and the transfer pump 610. The pumps 606, 608, 610 are trochoidal pumps. Accordingly, they include rotors 614, 616, 618 that are secured to and rotate with pump shaft 612. The rotors 614, 616, 618 are enclosed by a pump housing 620.

The pump housing 620 is comprised of an outer housing 622 that is secured to the crankcase member 118. The outer housing 622 forms an outer periphery of the pump unit 600. The pump housing 620 also includes an inner housing 624 and an inner cover 626 that is secured inside the outer housing 622. A pump cover 628 is secured to the rear side of the outer housing 622. The pump shaft 612 is rotatably supported in the pump cover 628 and the inner cover 626 through bearings 632 and 634.

The pump unit 600 is assembled by securing the outer housing 622 to the crankcase member 118 with a bolt 636. The inner housing 624 and inner cover 626 also are secured to the outer housing 622 with a bolt (not shown). A seal member 641 lies between the inner cover 626 and the crankcase member 118 and substantially prevents leakage. An additional bolt (not shown) secures the pump cover 628 to the outer housing 622.

With reference to FIGS. 7–8, the pump housing 620 defines an oil pump intake chamber 650 which collects oil from the shallow reservoir 268. A first inlet passage 652 and a second inlet passage 654, both of which are defined by the pump housing 620, are connected to the oil pump intake chamber 650. As indicated by the solid arrow 655 (FIG. 8), the first suction pump 606 draws lubricant from the reservoir 268 via the oil pump intake chamber 650 and the first inlet passage 652 and delivers the lubricant to a first outlet passage 656. Similarly, the second suction pump 608 draws lubricant from the reservoir 268 via the oil pump intake chamber 650 and the second inlet passage 654 and delivers it to a second outlet passage 658, as indicated by the alternate long and short dashed line 660.

A third inlet passage 662 connects the lubricant tank 604 with the transfer pump 610. As indicated by short dashed lines 664, the transfer pump 610 delivers lubricant from the third inlet passage 662 to a third outlet passage 668, which is also defined by the pump housing 622. From the third outlet passage 668, the lubricant is guided to various lubricant galleries configured to deliver lubricant to moving parts of the engine 112, as described below.

The lubricant tank 604 is secured to the outer housing 622 by mounting bolts 670. The third inlet passage 662 is connected an outlet opening 672 in the lubricant tank 604. The third outlet passage 668, which is connected to the transfer pump 610 and the third inlet passage 662, communicates with an engine lubrication passage 676. As shown in FIG. 7, a spring biased ball check valve 678 is located between the engine lubrication passage 676 and the transfer pump 610. This arrangement generally prevents the lubricant inside the lubricant tank 604 from draining towards the engine 12 when the engine 12 is shut off.

Figure 9:
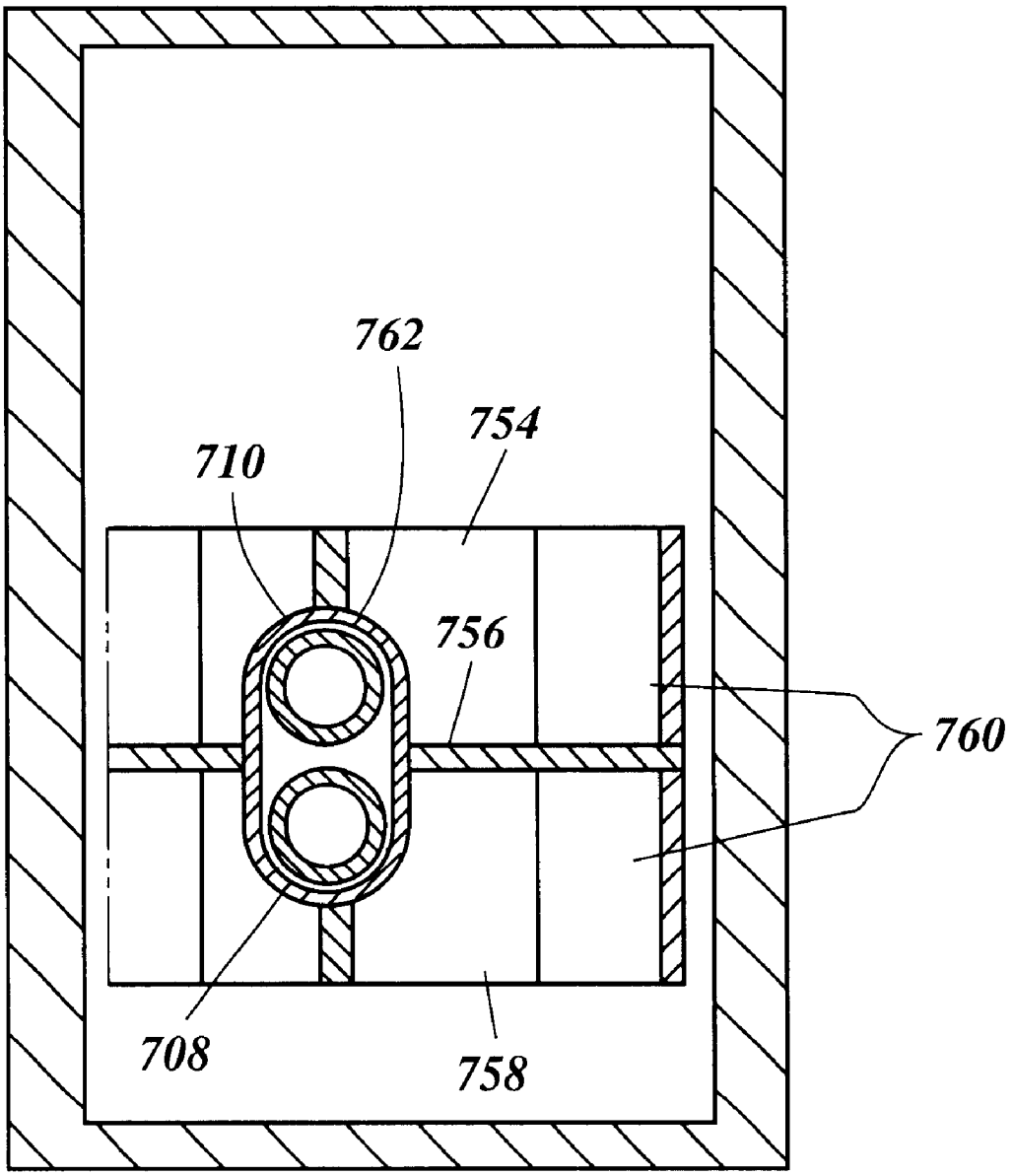
FIG. 9 is a cross-sectional view of the vapor separator taken along section line 9—9 of FIG. 7.

With reference to FIGS. 7–9, the lubricant tank 604 is comprised of a body 700 defining a lower portion of the lubricant tank 604, the body 700 is secured to the pump unit 600 by the mounting bolts 670. The tank 604 also includes a lid 702 defining an upper portion of the lubricant tank 604 and is secured by bolts 704 to the top of the tank body 700. The lid 702 includes a flange 703 defining an open lower surface 705 of the lid 702. Additionally, the body 700 includes a flange 707 than defines an open upper surface 709 of the body 700. The flanges 703,705 are connected to each other so as to close the open surfaces 705,709 thus seal the interior space of the tank 604.

The lubricant tank 604 also includes a vapor separator 706 that is located inside the tank body 700 and extends within and between the body 700 and the lid 702. Connection pipes 708 and 710 also extend through the tank body 700 and lid 702. The connection pipes 708, 710 are connected to the first and second outlet passages 656, 658, as best seen in FIG. 8. The connection is sealed by sealing ring 712.

The tank body 700 also includes a coolant passage 714 in its upper side that encircles the upper side of the tank body 700. Coolant is supplied from the cooling system through a coolant hose coupling member 716 located on the rear wall 718 of the tank body 700. The coolant is discharged from another coolant hose coupling member 719 that is also located on the rear wall 718. In the illustrated embodiment, the coolant passage is open along the open upper surface 709 of the body 700. The coolant passage is closed by the flange 703 of the lid 702. As such, the coolant passage is easier to manufacture.

With reference to FIG. 8, the lid 702 closes an upper opening of the tank body 700. The lid 702 includes a ventilation hose coupling member 730 and lubricant cap 734 with an integral lubricant level gauge. The lubricant cap 734 closes the lubricant filling port 736. The ventilation hose coupling member 730 is coupled to a hose (not shown) for delivering vapors inside the lubricant tank 604 to the intake system 160.

With reference to FIG. 7, the coupling member 730 is connected to the lubricant tank 604 by a communication passage 738 formed in the lid 702. In the illustrated arrangement, a ball-type check valve 740 is positioned in the communication passage 738 for preventing the passage of lubricant into the intake system 160 from the lubricant tank 604. The connection between the coupling member 730 and the communication passage 738 is sealed by a sealing member 674.

The vapor separator 706 is configured to remove vapors contained in the lubricant delivered from the first and second suction pumps 606, 608. The vapor separator 706 is comprised of an upper cover 750 that is secured by bolts 752 to the upper side of the lid 702. As illustrated in FIG. 9, the vapor separator 706 also includes three vertical plates 754, 756, 758 that extend downwardly from the upper cover 750. The vapor separator 706 further includes panels 760 that form a lubrication passage between the vertical plates 754–758. A pipe 762 penetrates the panels 760 and the middle vertical wall 756. The pipe 762 surrounds the connection pipes 708, 710.

With reference to FIG. 7, the upper cover 750 supports the upper ends of the connection pipes 708, 710 and a press member 764 which is clamped between the lid 702. The connection pipes 708, 710 are inserted through holes 766 that are formed in the middle of the upper cover 750. Lubricant ports 768 are provided at the sides of the upper cover 750.

The lubricant ports 768 guide lubricant from the connection pipes 708, 710 towards the vapor separator 706. The lubricant then passes through the vapor separator 706, which separates vapors from the lubricant. Vapors are then delivered to the intake system 160 through the communication passage 738 and ventilation hose (not shown). The lubricant is then collected within the tank body 700 to be available for distribution throughout the engine 12.

Lubricant within the tank body 700 is provided to the transfer pump 610 by the third inlet passage 662. As discussed previously, the third inlet passage 662 communicates with the tank body 700 via the outlet opening 672. The transfer pump 610 receives lubricant from the third inlet passage 662 and pumps it to the third outlet passage 668, which is connected to engine lubrication passage 676. From the engine lubrication passage 676, the lubricant is distributed to lubricant galleries provided in the engine body 112 for lubricating moving parts in the engine body 112 by the transfer pump 610. For example, lubricant is supplied to lubricant passages formed within the crankcase member 118 for lubricating the crankshaft 128. Additionally, lubricant is supplied to lubricant galleries configured to guide lubricant to the camshafts, valves and cylinder bores 120. An oil filter is typically provided between the lubricant galleries and the transfer pump 610. The lubricant is then returned to the reservoir 268 to be available for redistribution, as described above.

Figure 4:
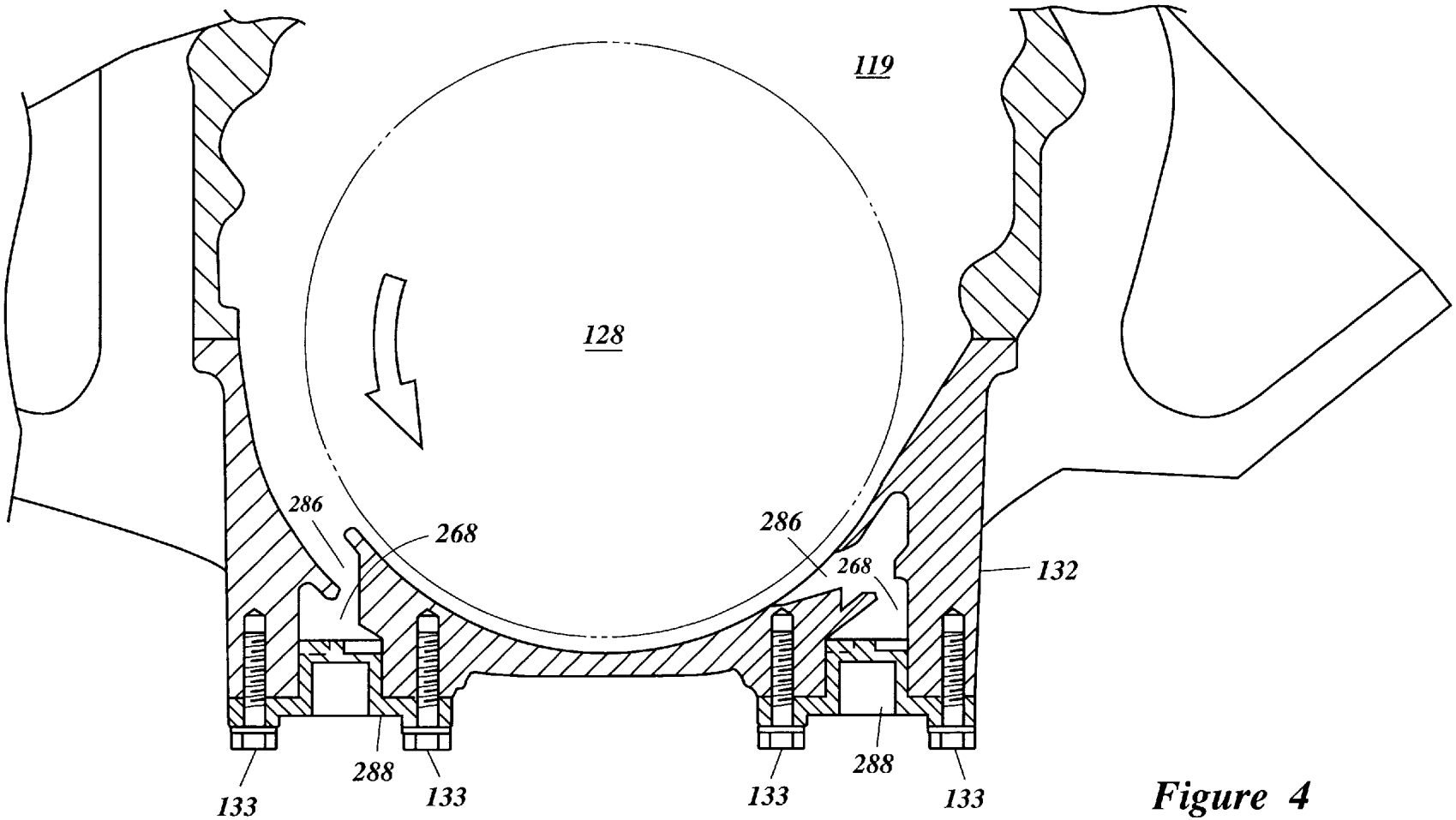
FIG. 4 is a rear cross-sectional view of a lower portion of the engine taken along section line 4—4 of FIG. 7.

With reference to FIG. 4, the lubrication system 284 also includes lubricant collecting passages 286 formed at the bottom of the crankcase chamber 119. The lubricant collecting passages 286 preferably are formed by the lower crankcase member 132. Preferably, the openings of the passages 286 are generally tangential to the crankshaft 128. With such a construction, the crankshaft 128 advantageously assists the collection of lubricant.

The collecting passages 286 communicate with the reservoir 268, which is defined by the bottom of the crankcase member 118 and lower covers 288 that are secured to the lower crankcase member 132 by a plurality of bolts 133. The illustrated embodiment includes two reservoirs 268, one located on each side of the axis of the crankshaft 128 (illustrated schematically). The lower covers 288, and thus the reservoirs 268, extend substantially along the length of the lower crankcase member 132. The reservoirs 268 connect to the oil pump intake chamber 650. Preferably, at least one pair of passages 286 are provided for each cylinder 120. With such an arrangement, lubricant can be removed from the four cylinders 120 to the oil pump intake chamber 650.

Figure 5:
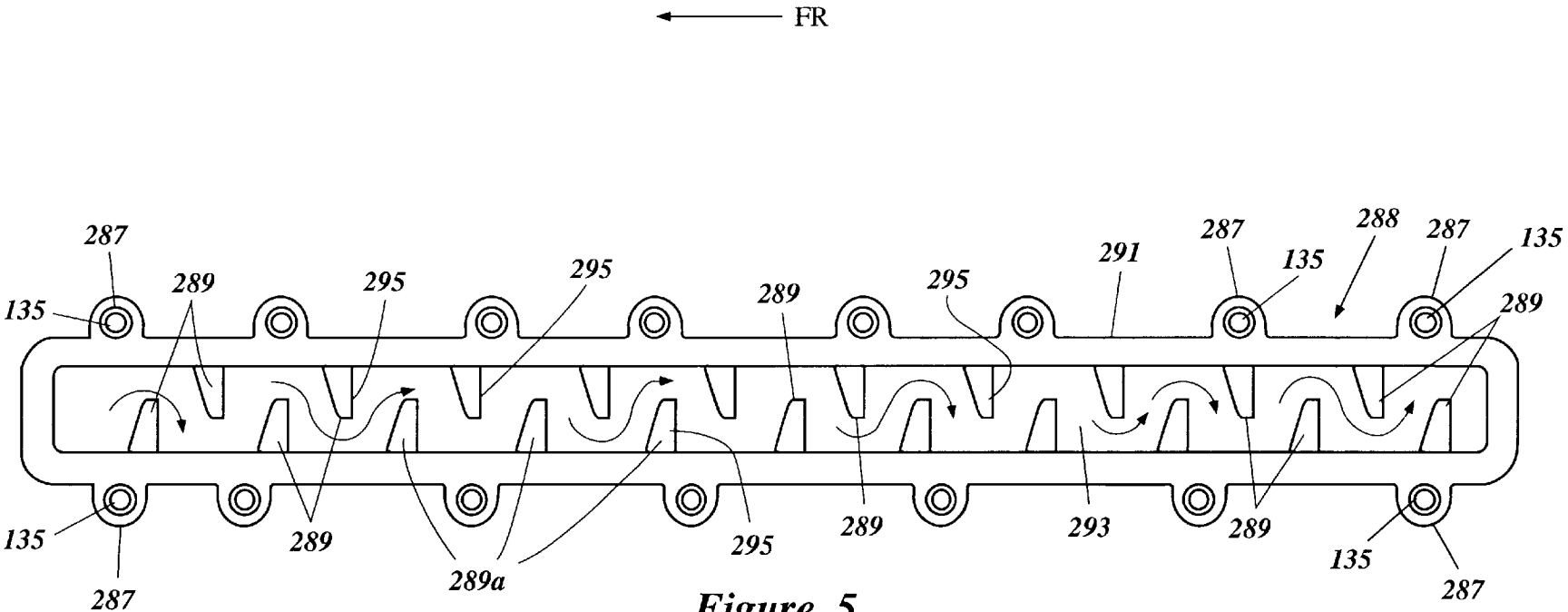
FIG. 5 is a top plan view of a preferred embodiment of an oil cover.
Figure 6:
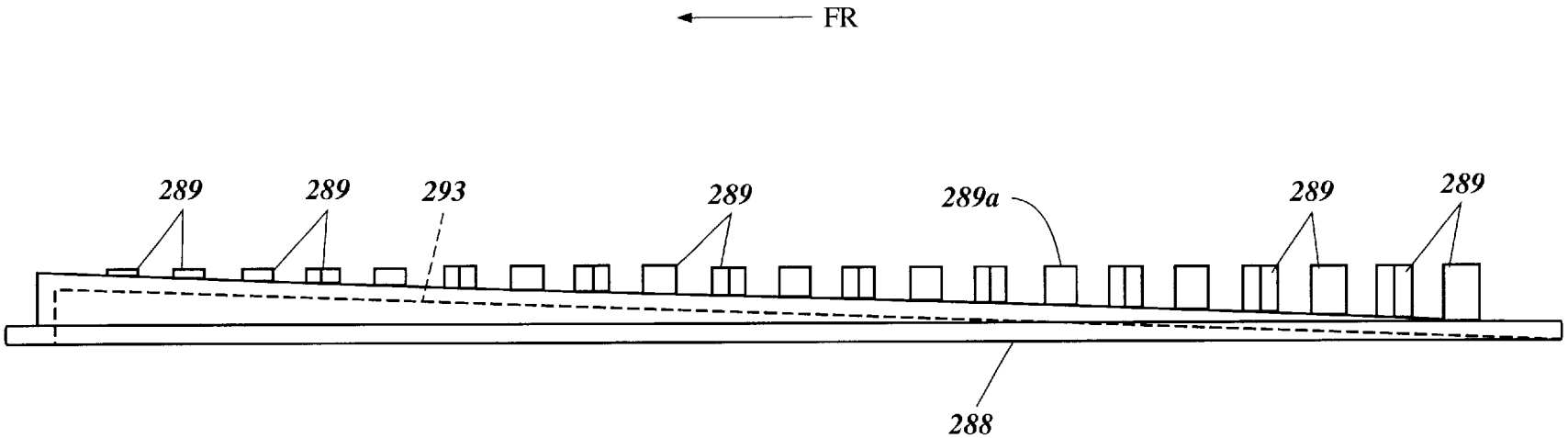
FIG. 6 is a side elevational view of the oil cover of FIG. 5.

With reference to FIGS. 5 and 6, one of the pair of lower covers 288 is shown in detail. The cover 288 defines a sealing surface 291 along its periphery for creating a seal with a mating surface of the lower crankcase member 132. Preferably, a gasket or other suitable sealing material is placed between the cover 288 and mating surface of the crankcase member 132. A plurality of tabs 287 extend from, and are preferably coplanar with, the sealing surface 291. Each tab 287 includes an aperture 135 for the bolts 133 to pass therethrough.

With reference to FIG. 6, the cover 288 includes a bottom surface 293 that preferably is inclined with respect to the sealing surface 291 and with respect to the axis of the crankshaft 128. A plurality of baffles 289 extend upwardly from the bottom surface 293, preferably approximately normal to the sealing surface 291. Additionally, the top surfaces 289*a* of each of the baffles 289 are approximately coplanar with one another, and lie in a plane parallel to the sealing surface 291.

The baffles 289 also define redirection surfaces 295 that face the rear of the engine 12. Preferably, the redirection surfaces 295 are substantially transverse with respect to a longitudinal axis of the watercraft 10. The baffles 289, together, define a zig zag channel in the space therebetween. As can be appreciated by one skilled in the art, although illustrated with the aforementioned structure, the baffles 289 may take on a variety of different shapes and still accomplish substantially the same result. For example, the redirection surfaces 295 may be of varying size or shape, or the baffles may comprise compound redirection surfaces 295.

In normal operation, the incline of the watercraft 10 when up on plane or at rest in combination with the inclined bottom surface 293 of the cover 288, urges the lubricant to flow toward the oil pump intake chamber 650 at the rear of the engine 12 (as represented by the arrows in FIG. 5). In such a situation, an ample supply of oil is available to the oil pump unit 600 such that the oil pump 600 remains primed with oil. However, when the watercraft 10 decelerates rapidly (negative forward acceleration) lubricant within the reservoir 268 tends to rush forwardly, away from the oil pump intake chamber 650. If unimpeded, the lubricant may collect toward the front of the reservoir 268 and be unavailable for circulation by the oil pump unit 600, thus allowing the oil pump unit 600 to ingest air. Advantageously, with the present construction the oil is impeded from flowing away from the oil pump unit 600. For example, but without limitation, the redirection surfaces 295 of each baffle 289 impede the flow of oil away from the oil pump unit 600. Thus, sufficient lubricant is available for circulation by the oil pump unit 600 while reducing the likelihood that the oil pump unit 600 will ingest air.

FIGS. 10–17 illustrate a modification of the reservoir 268 preferred for use with a dry sump lubrication system 284. As this modification is similar to the embodiment disclosed in relation to FIGS. 3–9, like reference numerals will be used to describe like components, except a "'" has been added thereto.

Figure 10:
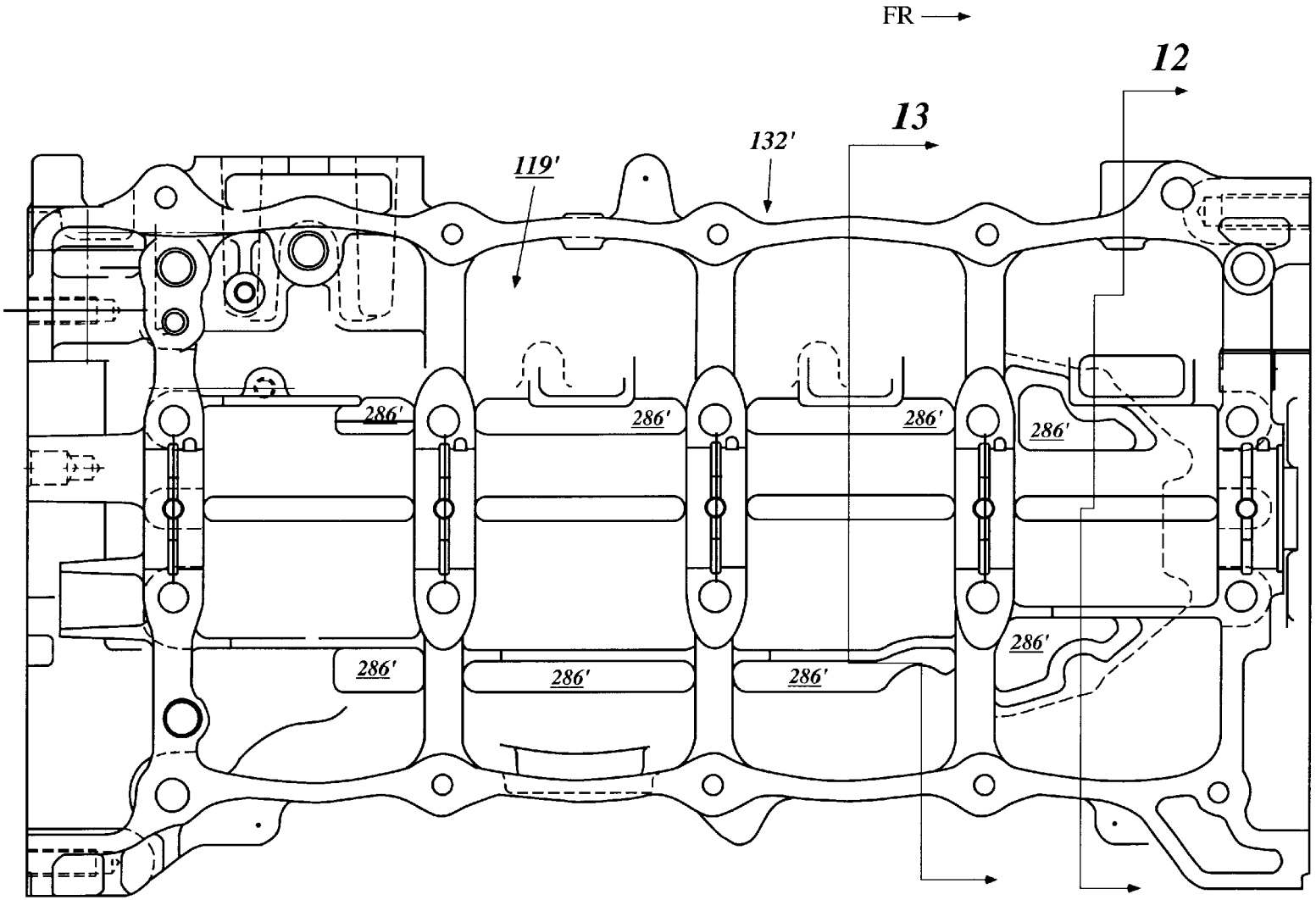
FIG. 10 is a top plan view of a crankcase member of the engine.
Figure 11:
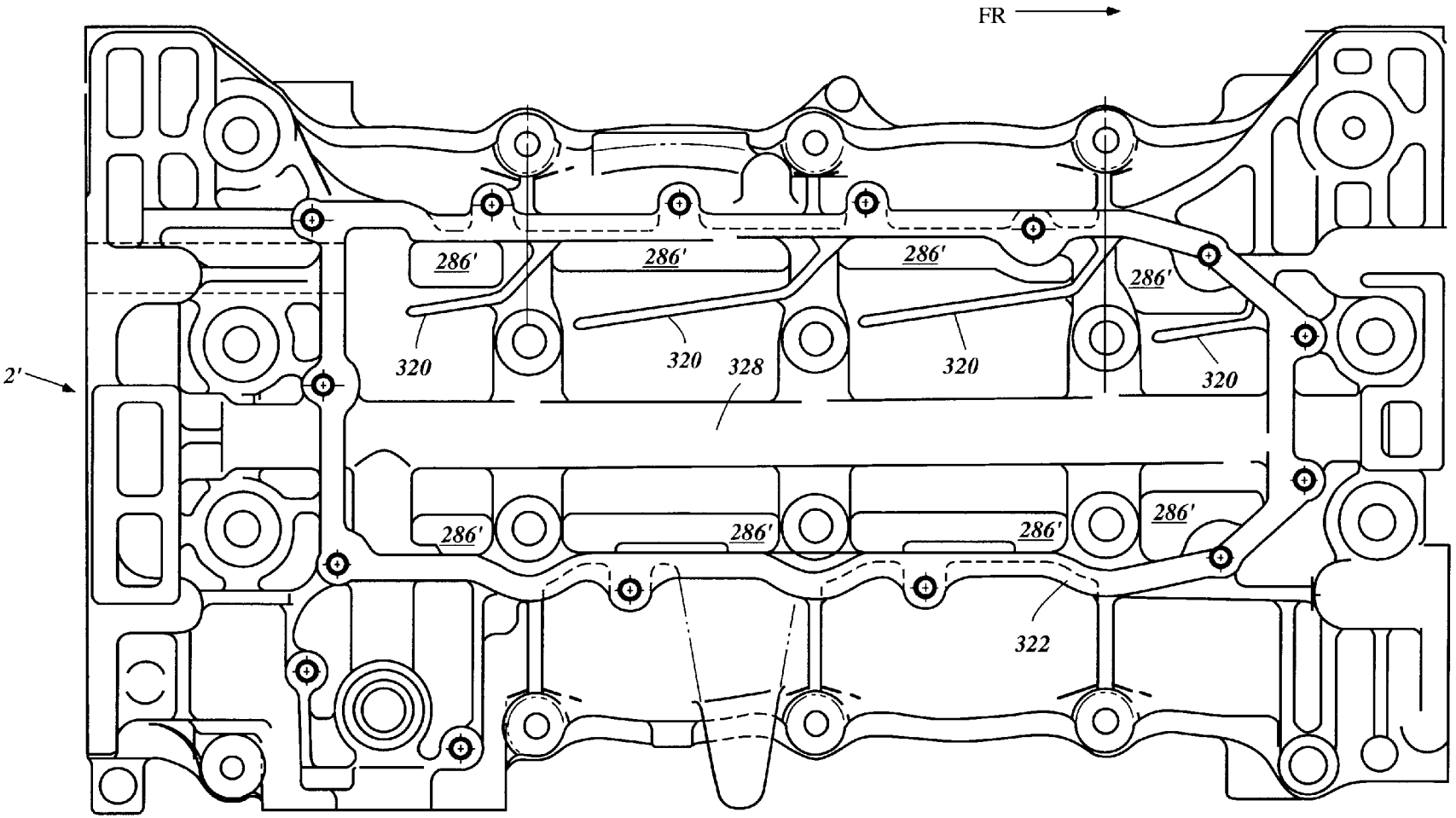
FIG. 11 is a bottom plan view of the crankcase member.
Figure 12:
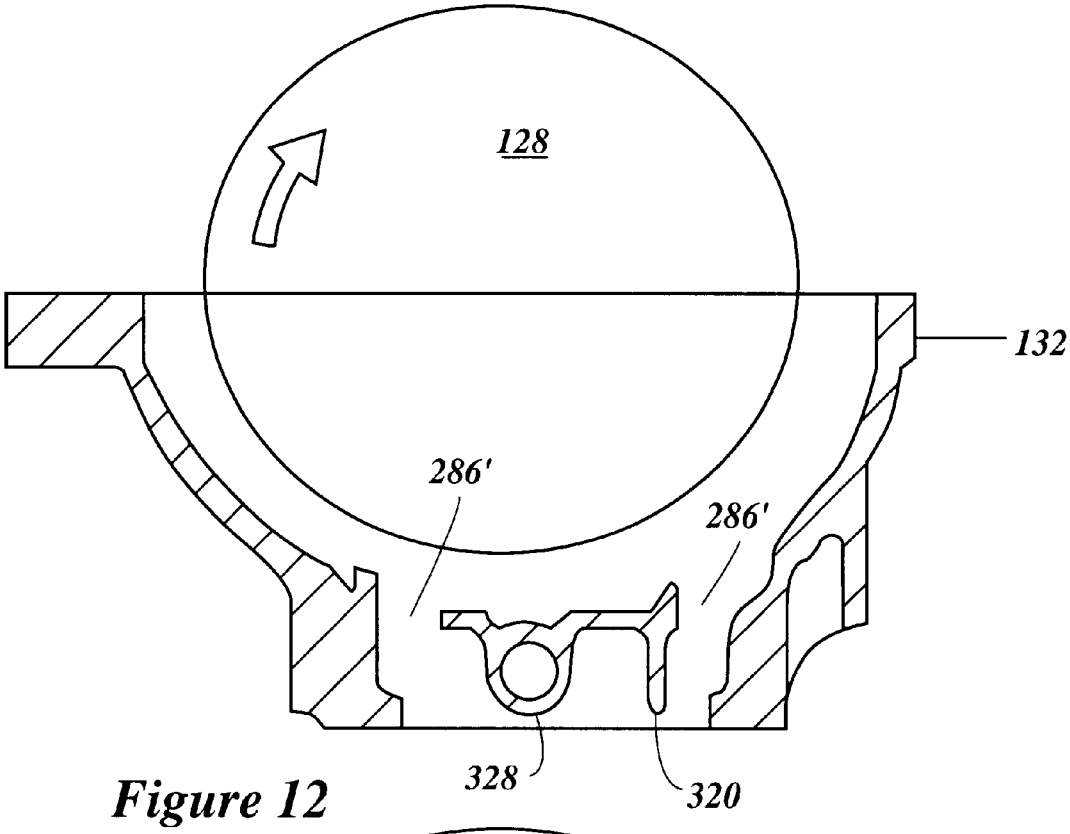
FIG. 12 is a cross-sectional view of the crankcase member taken along section line 12—12 of FIG. 10.
Figure 13:
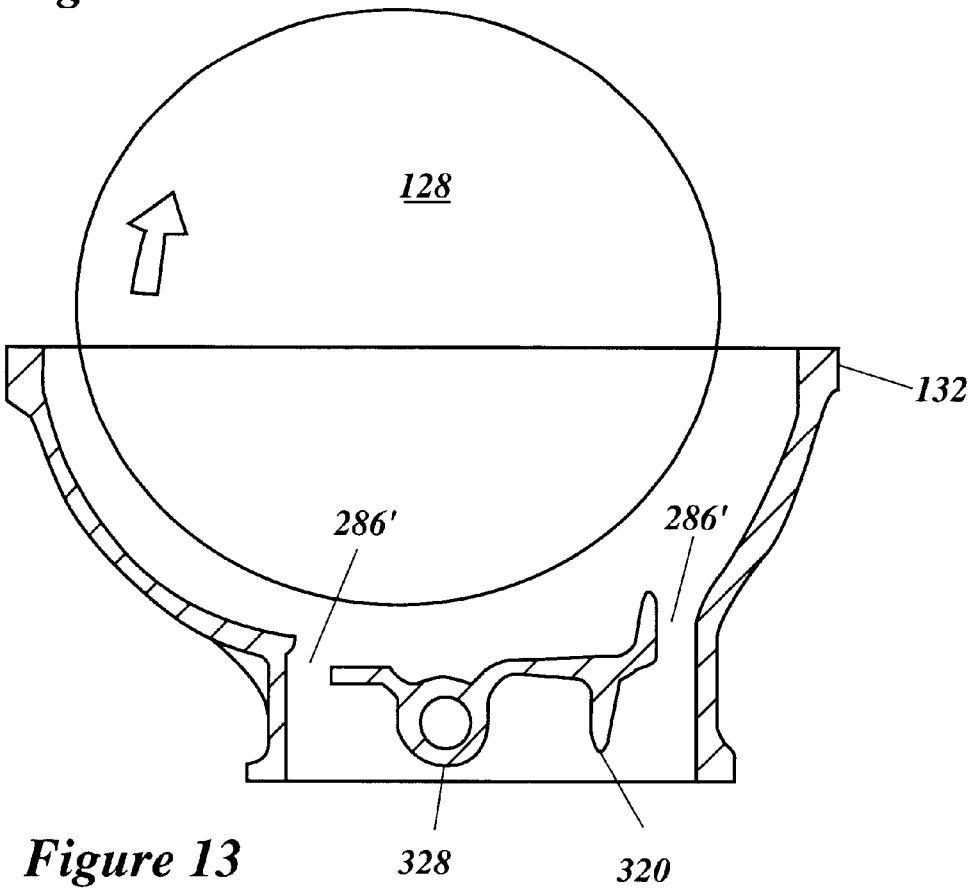
FIG. 13 is a cross-sectional view of the crankcase member taken along section line 13—13 of FIG. 10.

The lubrication system 284 illustrated in FIGS. 10–17 utilizes a single reservoir 268', and thus a single lower cover 288'. As best seen in FIGS. 12 and 13, lubricant collecting passages 286' are formed at the bottom of the crankcase member 132' and the crankshaft 128' assists in collection of the lubricant, substantially as described above.

A top plan view of the crankcase member 132' is illustrated in FIG. 10. A pair of lubricant collecting passages 286' are provided for each cylinder 120. One of the pair of passages 286' is provided on either side of the axis of the crankshaft 128.

FIG. 11 illustrates a bottom plan view of the crankcase member 132'. A plurality of crankcase baffles 320 are provided, one related to each lubricant collecting passage 286. The crankcase baffles 320 are disposed substantially to the front of, and substantially surround two sides of, their respective passages 286'. Preferably, the bottom edge surfaces of the crankcase baffles 320 are substantially coplanar with a sealing surface 322 along the periphery of the crankcase member 132. The sealing surface 322 provides a mating surface for a related sealing surface 291' of the lower oil cover 288' and is parallel to the axis of the crankshaft 128.

Figure 14:
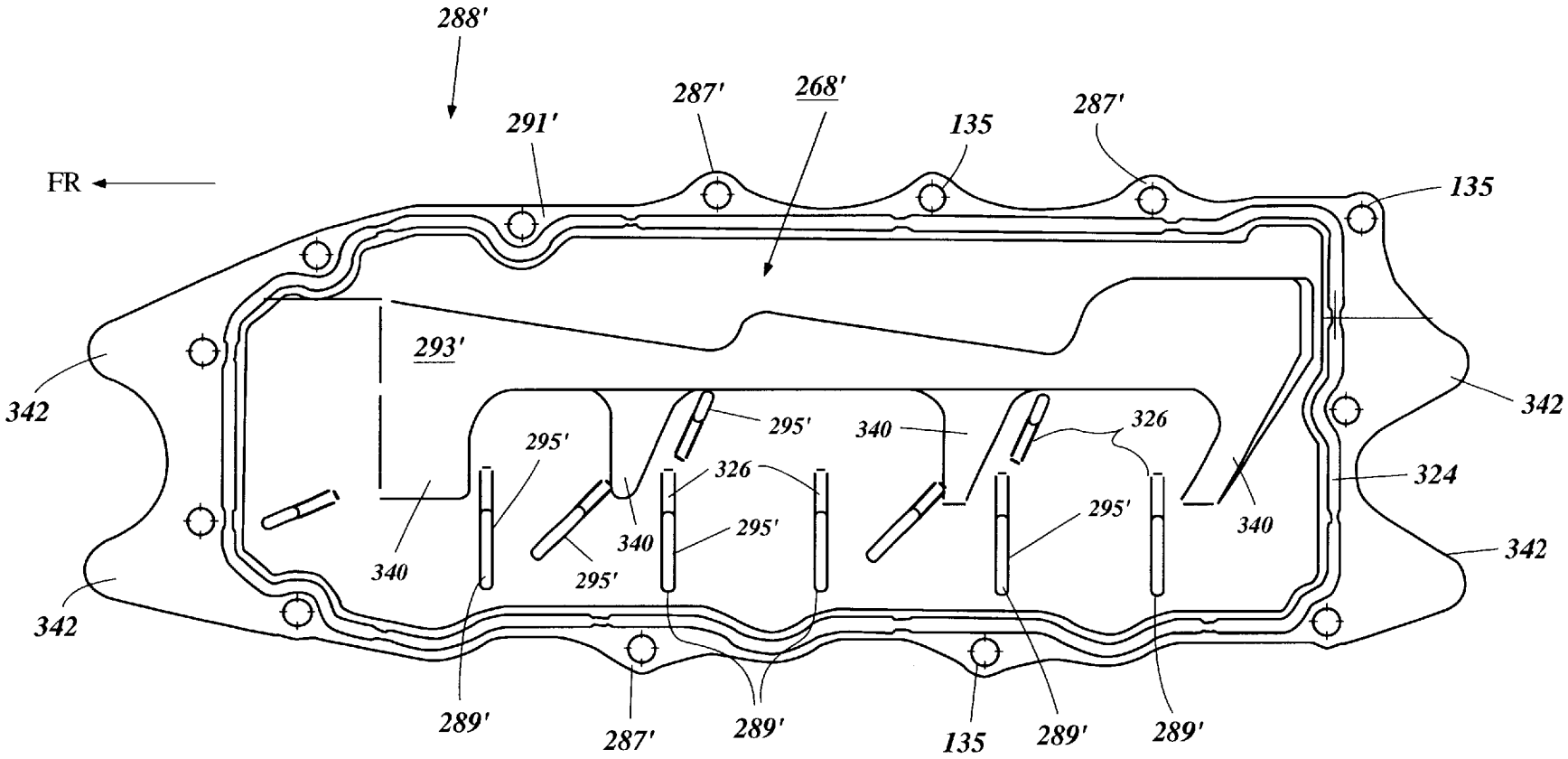
FIG. 14 is a top plan view of a modification of the oil cover illustrated in FIG. 5.
Figure 15:
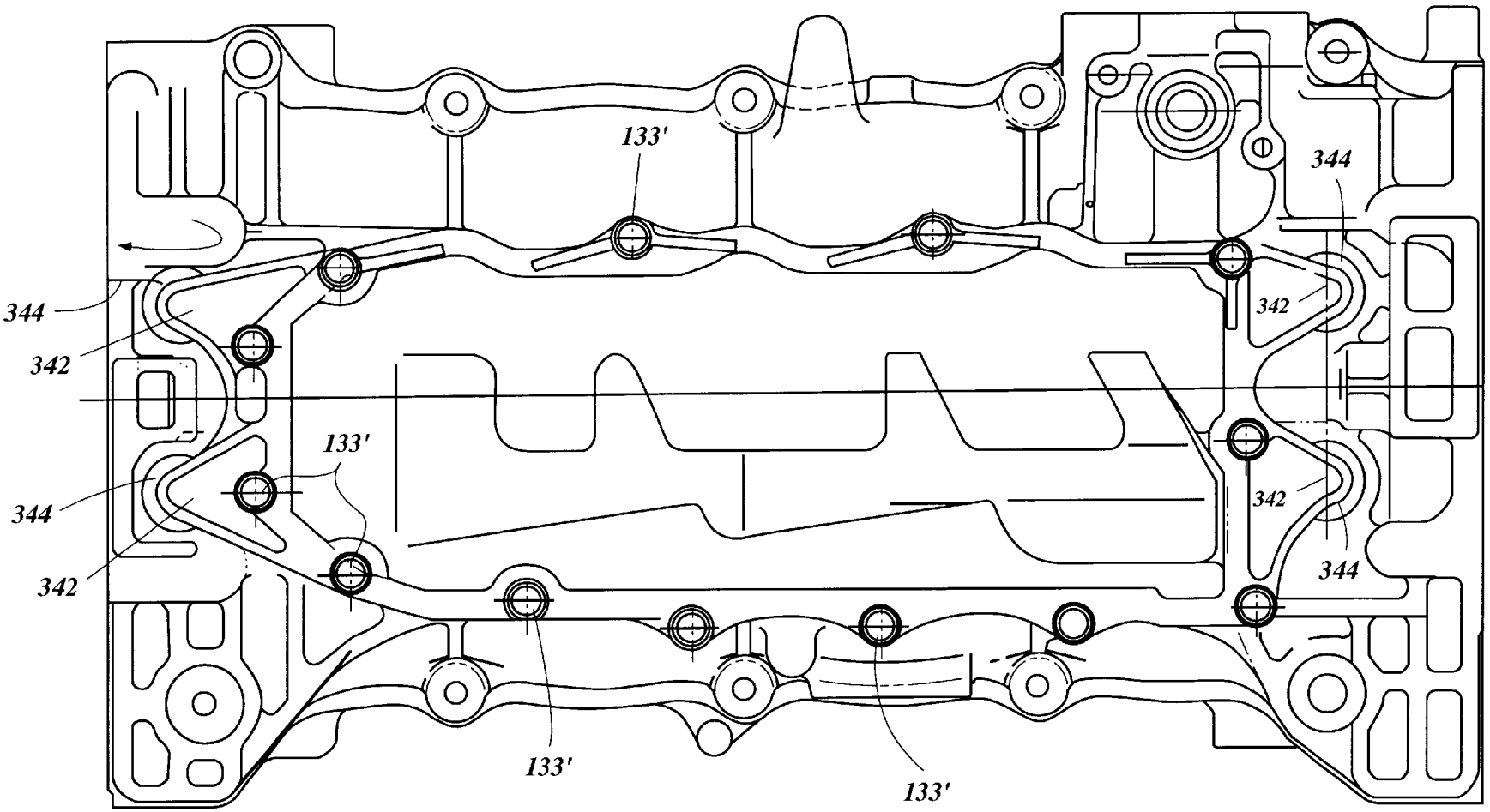
FIG. 15 is a bottom plan view of the engine including the oil cover of FIG. 14.
Figure 16:
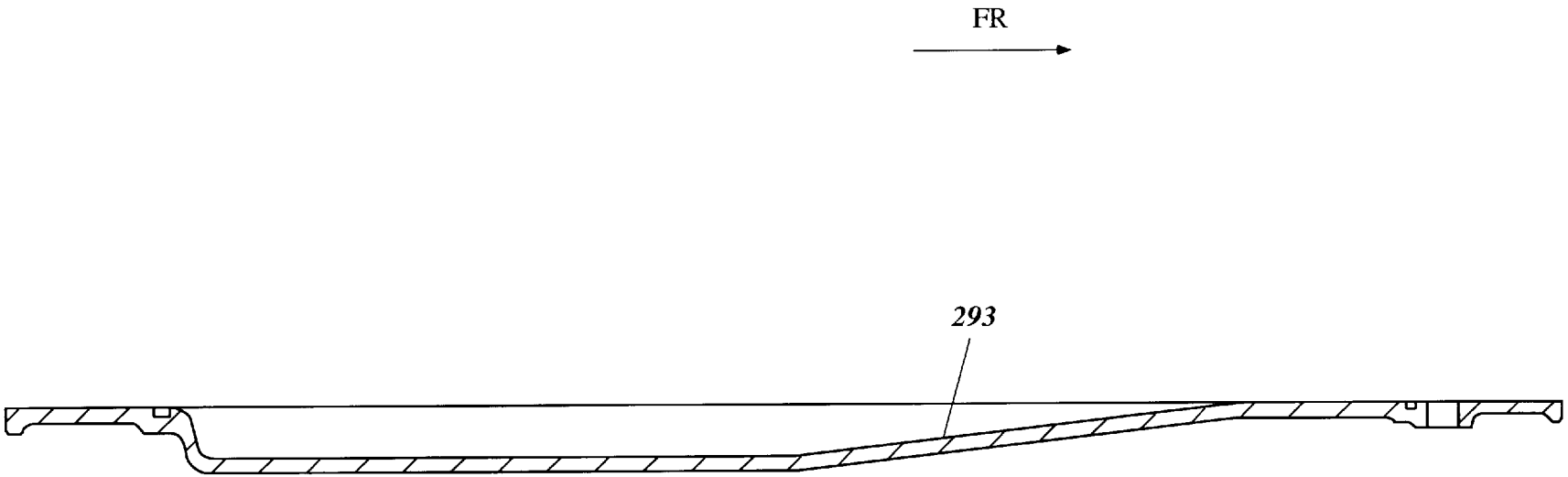
FIG. 16 is a cross-sectional view of the oil cover of FIG. 14 taken along section line 16—16.

With reference to FIGS. 14–15, the lower cover 288' is illustrated in top and bottom plan views, respectively. The cover 288' defines a sealing surface 291' along its periphery for mating with the sealing surface 322 of the crankcase member 132'. When connected, the cover 288' and crankcase member 132' define a reservoir 268' therebetween. Preferably, a groove is provided to seat a sealing member, such as an o-ring or other suitable sealing material, between the cover 288' and the crankcase member 132'. Preferably, the cover 288' is connected to the crankcase member 132' with a plurality of bolts 133'.

A portion of the bottom surface of the cover 288' defines an inclined surface 293' that is inclined with respect to the sealing surface 291'. The inclined surface 293' preferably extends substantially along the length of the cover 288' and is disposed substantially on one side of the axis of the crankshaft 128. A plurality of baffles 289' extend up from the bottom surface of the cover 288'. Preferably, the baffles 289' are disposed substantially on the opposite side of the axis of the crankshaft 128 as the inclined surface 293'.

The top surfaces of each of the baffles 289' are preferably coplanar with one another, and substantially coplanar with the sealing surface 291'. Redirection surfaces 295' are defined on the surface of the baffles 289' facing the rear of the engine 12. Some of the redirection surfaces 295' are transverse to a longitudinal axis of the watercraft 10, while other redirection surfaces 295' are canted with respect to the longitudinal axis. A plurality of inlet channels 340 originate at the inclined surface portion 293' of the cover 288' and extend transversely therefrom. A pair of baffles 289', preferably including one with a transverse redirection surface 295' and one with a canted redirection surface 295', cooperate to form a funnel shape therebetween leading to an inlet channel 340.

When the cover 288' is connected to the crankcase member 132, the crankcase baffles 320 create a shape that is complementary to the shape of the perimeter of the inclined surface portion 293'. Additionally, the baffles 289' include a cut out 326 that is complementary to a longitudinally extending protrusion 328 in the crankcase member 132.

In normal operation of the watercraft 10, lubricant entering the reservoir 268' from the oil collecting passages 286' on one side of the axis of the crankshaft 128 is guided to the inclined surface 293' by the crankcase baffles 320. The incline of the watercraft 10 when up on plane or at rest in combination with the inclined surface portion 293 of the cover 288' urges lubricant in the reservoir 268' toward the oil pump unit 600. Additionally, the lubricant entering the reservoir 268' from the oil collecting passages 286' on the opposite side of the axis of the crankshaft 128 is guided to the inlet channels 340 by the funnel shape formed by the baffles 289'. From the inlet channels 340, the lubricant enters the inclined surface 293' of the cover 288' and is similarly urged toward the oil pump unit 600. If the watercrafit 10 experiences sudden deceleration, the crankcase baffles 320 impede the movement of lubricant away from the passages 286' and the oil pump unit 600. Additionally, the baffles 289' of the cover 288' impede the movement of lubricant away from the passages 286' and the oil pump unit 600.

Figure 17:
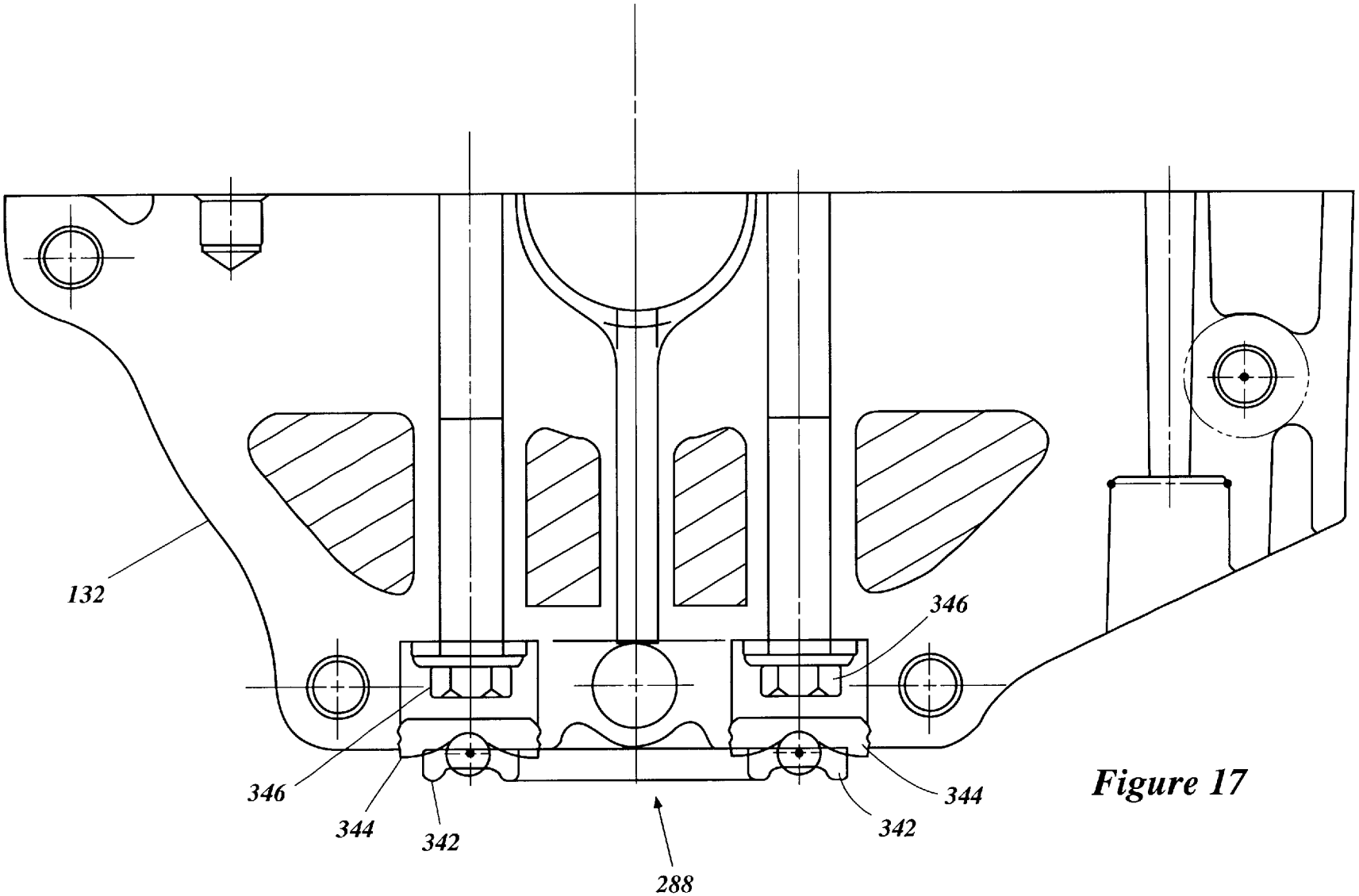
FIG. 17 is a cross-sectional view of a lower rear portion of the engine taken along section line 17—17 in FIG. 15.

With reference to FIGS. 14–17 the cover 288' illustrated in FIGS. 14–17 is that it includes a plurality of projections 342 configured to secure a plurality of plugs 344 within their respective counter sink portions of the lower crankcase member 132'. FIG. 17 illustrates a cross sectional view of a rear portion of the engine 12. Two of the four bolts 346 (see FIG. 15) are shown connecting the lower crankcase member 132' to the upper crankcase member 130'. A plug 344, preferably made from rubber, or another suitable elastomeric material, is inserted into the countersink portion of the lower crankcase member 132' to prevent water (especially salt water) from coming into contact with the bolt 346, which may lead to degradation of the bolt 346. When the cover 288' is secured in place on the lower crankcase member 132' by plurality of bolts 133', the projections 342 substantially cover the plugs 344 and secure them in place.

Advantageously, with such a construction a portion of the plugs 344 may be left protruding from the countersink portion of the crankcase member 132'. In this manner, the plugs are easily removed when the cover 288' is removed and securely held in place when the cover 288' is connected to the crankcase member 132'.

Of course, the foregoing description is that of certain features, aspects and advantages of the present invention to which various changes and modifications may be made without departing from the spirit and scope of the present invention. Moreover, a watercraft may not feature all objects and advantages discussed above to use certain features, aspects and advantages of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. The present invention, therefore, should only be defined by the appended claims.

What is claimed is:

1. A small watercraft comprising a hull defining an engine compartment, an internal combustion engine supported within the engine compartment and having an engine body defining at least one cylinder bore therein, the engine body defining a crankcase having a crankshaft rotatably supported therein, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity at a position toward a rear end of the engine, the oil cover including at least one baffle on a bottom surface of the oil cavity and being configured to impede a flow of oil in a forward direction away from the oil pump inlet, the baffle being skewed relative to a longitudinal axis of the watercraft.

2. The watercraft of claim 1, where in the at least one baffle is configured to impede a rapid flow of oil in a direction away from the oil pump inlet in response to rapid deceleration of the watercraft.

3. The watercraft of claim 1, wherein the oil cover comprises an inclined lower surface configured to guide oil to the oil pump inlet.

4. The watercraft of claim 3, additionally comprising a plurality of baffles having a redirection surface at least partially transverse to a longitudinal axis of the watercraft.

5. The watercraft of claim 1, wherein the oil cover includes an inclined surface configured to guide oil to the oil pump.

6. A small watercraft comprising a hull defining an engine compartment, an internal combustion engine supported within the engine compartment and having an engine body defining at least one cylinder bore therein, the engine body defining a crankcase having a crankshaft rotatably supported therein, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity at a position toward a rear end of the engine, the oil cover including at least one baffle being configured to impede a flow of oil in a forward direction away from the oil pump inlet, additionally comprising a crankcase member defining the crankcase and supporting the crankshaft within the crankcase, the crankcase member including a lower surface defining a first oil passage and a second oil passage connecting the crankcase with the oil cavity, the first oil passage being located on one side of a plane extending parallel to the cylinder bore through an axis of the crankshaft and the second oil passage being located on the other side of the plane, the oil cover comprising a first oil cover and a second oil cover, the oil cavity comprising a first oil cavity and a second oil cavity, the first oil cover defining the first oil cavity and the second oil cover defining the second oil cavity, the first oil cavity being in fluid communication with the first oil passage and the second oil cavity being in fluid communication with the second oil passage.

7. The watercraft of claim 6, wherein each of the first and second oil covers include a plurality of baffles defining a redirection surface disposed substantially transverse to a flow of oil toward the oil pump.

8. The watercraft of claim 7, wherein the baffles of each of the first and second oil covers are configured to form a zigzag pattern of oil flow toward the oil inlet.

9. The watercraft of claim 6, wherein the first and second oil passages are substantially rectangular and a plurality of baffles are provided on the engine body, each of the baffles on the engine body being paired with one of the oil passages and each of the baffles of the engine body substantially surrounding at least two sides of the respective oil passage.

10. The watercraft of claim 9, wherein each oil passage is disposed substantially between the oil pump and a corresponding baffle of the engine body.

11. A small watercraft comprising a hull defining an engine compartment, an internal combustion engine supported within the engine compartment and having an engine body defining at least one cylinder bore therein, the engine body defining a crankcase having a crankshaft rotatably supported therein, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity at a position toward a rear end of the engine, the oil cover including a plurality of baffles configured to impede a flow of oil in a forward direction away from the oil pump inlet, the oil cover comprising an inclined lower surface configure to guide oil to the oil pump inlet, and wherein a top surface of the each of the baffles lies substantially in a first plane and the inclined surface defines a second plane, the first plane being inclined with respect to the second plane.

12. A small watercraft comprising a hull defining an engine compartment, an internal combustion engine supported within the engine compartment and having an engine body defining at least one cylinder bore therein, the engine body defining a crankcase having a crankshaft rotatably supported therein, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity at a position toward a rear end of the engine , the oil cover including at least one baffle being configured to impede a flow of oil in a forward direction away from the oil pump inlet, wherein the at least one baffle of the engine body is disposed outside of a perimeter defined by the ramped surface.

13. The watercraft of claim 12, wherein the at least one baffle comprises a plurality of baffles provided on the engine body, the plurality of baffles being shaped so as to compliment at least a portion of the perimeter of the ramped surface.

14. The watercraft of claim 13, wherein the ramped surface includes at least one inlet channel disposed substantially normal to a direction of slope of the inclined surface.

15. The watercraft of claim 14, additionally comprising a plurality of baffles on the oil cover, at least one of the baffles defining an angled redirection surface that is angled with respect to a flow of oil away from the oil pump.

16. The watercraft of claim 15, wherein the normal redirection surface of at least one of the baffles on the oil cover and the at least one angled redirection surface are configured to funnel oil into an inlet channel.

17. A small watercraft comprising a hull defining an engine compartment, an internal combustion engine supported within the engine compartment and having an engine body defining at least one cylinder bore therein, the engine body defining a crankcase having a crankshaft rotatably supported therein, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity at a position toward a rear end of the engine, the oil cover including at least one baffle being configured to impede a flow of oil in a forward direction away from the oil pump inlet, wherein at least one baffle includes a cut out shaped complementary to a protrusion formed parallel to the crankshaft axis on a bottom side of the crankcase.

18. A small watercraft comprising a hull defining an engine compartment, an internal combustion engine supported within the engine compartment and having an engine body defining at least one cylinder bore therein, the engine body comprising at least a first and second member, the first and second member being connected by at least one bolt, the bolt having a bolt head disposed within a countersink portion of the engine body, a plug substantially sealing the bolt head within the countersink portion, the oil cover comprising at least one projection at least partially covering the plug.

19. The small watercraft of claim 18, wherein at least a portion of the plug protrudes from the countersink portion.

20. A small watercraft comprising a hull defining an engine compartment, an internal combustion engine supported within the engine compartment and having an engine body defining at least one cylinder bore therein, the engine body defining a crankcase having a crankshaft rotatably supported therein, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity at a position toward a rear end of the engine, the crankcase defining at least a pair of oil passages located in a lower surface of the crankcase and spaced along a longitudinal axis of the engine, means for defining oil traps for oil draining through the oil passages.

21. The small watercraft of claim 20, wherein the oil cover additionally comprises at least one baffle configured to impede a flow of oil in a forward direction away from the inlet.

22. The small watercraft of claim 21, wherein the oil cover additionally comprises an inclined lower surface configured to guide oil to the inlet.

23. An internal combustion engine having an engine body defining at least one cylinder bore therein, the engine body further defining a crankcase, a crankshaft rotatably supported in the crankcase, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity, the oil cover including at least one baffle on a bottom surface of the oil cavity and being configured to impede a flow of oil away from the oil pump inlet, the baffle being skewed relative to a longitudinal axis of the watercraft.

24. The engine of claim 23, wherein the at least one baffle is configured to impede a rapid flow of oil in a direction away from the oil pump inlet in response to rapid acceleration toward the inlet of the oil pump.

25. The engine of claim 23, wherein the oil cover comprises an inclined lower surface configured to guide oil to the oil pump inlet.

26. The engine of claim 25, additionally comprising a plurality of baffles having a redirection surface at least partially transverse to a longitudinal axis of the engine.

27. An internal combustion engine having an engine body defining at least one cylinder bore therein, the engine body further defining a crankcase, a crankshaft rotatably supported in the crankcase, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity, the oil cover including a plurality of baffles configured to impede a flow of oil away from the oil pump, wherein the oil cover additionally comprises a sealing surface along a substantial perimeter of the oil cavity, a top edge of each of the baffles lying substantially in a plane defined by the sealing surface.

28. An internal combustion engine having an engine body defining at least one cylinder bore therein, the engine body further defining a crankcase, a crankshaft rotatably supported in the crankcase, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity, the oil cover including a plurality of baffles configured to impede a flow of oil away from the oil pump, the oil cover comprising an inclined lower surface configured to guide oil to the oil pump inlet, and wherein a top surface of the each of the baffles lies substantially in a first plane and the inclined surface defines a second plane, the first plane being inclined with respect to the second plane.

29. An internal combustion engine having an engine body defining at least one cylinder bore therein, the engine body further defining a crankcase, a crankshaft rotatably supported in the crankcase, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity, the oil cover including a plurality of baffles configured to impede a flow of oil away from the oil pump, the engine body additionally comprising a crankcase member defining the crankcase and supporting the crankshaft within the crankcase, the crankcase member including a lower surface defining a first oil passage and a second oil passage connecting the crankcase with the oil cavity, the first oil passage being located on one side of a plane extending parallel to the cylinder bore through an axis of the crankshaft and the second oil passage being located on the other side of the plane, the oil cover comprising a first oil cover and a second oil cover and the oil cavity comprising a first oil cavity and a second oil cavity, the first oil cover defining the first oil cavity and the second oil cover defining the second oil cavity, the first oil cavity being in fluid communication with the first oil passage and the second oil cavity being in fluid communication with the second oil passage.

30. The engine of claim 29, wherein each of the first and second oil covers include a plurality of baffles defining a redirection surface disposed substantially transverse to a flow of oil toward the oil pump.

31. The engine of claim 30, wherein the baffles of each of the first and second oil covers are configured to form a zigzag oil channel.

32. The engine of claim 29, wherein the oil passages are substantially rectangular and a plurality of baffles are provided on the engine body, each of the baffles on the engine body being paired with one of the oil passages and each of the baffles of the engine body substantially surrounding at least two sides of the respective oil passage.

33. The engine of claim 32, wherein each oil passage is disposed substantially between the oil pump and one of the baffles.

34. The engine of claim 29, wherein the oil cover further includes an inclined surface configured to guide oil to the oil pump.

35. The engine of claim 32, wherein at least one of the baffles is disposed outside of a perimeter defined by the ramped surface.

36. The engine of claim 35, wherein a shape of the plurality of baffles compliments at least a portion of the perimeter of the ramped surface.

37. The engine of claim 36, wherein the ramped surface includes at least one inlet channel disposed substantially normal to a direction of slope of the inclined surface.

38. The engine of claim 37, additionally comprising a plurality of baffles on the oil cover, at least one of the baffles defining an angled redirection surface that is angled with respect to a flow of oil away from the oil pump, wherein the normal redirection surface of at least one of the baffles on the oil cover and the at least one angled redirection surface are configured to funnel oil into an inlet channel.

39. An internal combustion engine having an engine body defining at least one cylinder bore therein, the engine body further defining a crankcase, a crankshaft rotatably supported in the crankcase, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity, the oil cover including a plurality of baffles configured to impede a flow of oil away from the oil pump, wherein the at least one baffle includes a cut out shaped complementary to a protrusion formed parallel to the crankshaft axis on a bottom side of the crankcase.

40. A small watercraft comprising a hull defining an engine compartment, an internal combustion engine supported within the engine compartment and having an engine body defining at least one cylinder bore therein, the engine body defining a crankcase having a crankshaft rotatably supported therein, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity, the oil cover including a plurality of baffles on a bottom surface of the oil cavity, the plurality of baffles being skewed relative to a longitudinal axis of the watercraft, and at least a portion of the baffles being generally transverse to the longitudinal axis.

41. A small watercraft comprising a hull defining an engine compartment, an internal combustion engine supported within the engine compartment and having an engine body defining at least one cylinder bore therein, the engine body defining a crankcase having a crankshaft rotatably supported therein, at least one oil cover connected to the engine body and defining an oil cavity therebetween, at least one oil gallery defined within the engine body, an oil pump configured to circulate oil between the oil cavity and the oil gallery, the oil pump having an inlet configured to draw oil from the oil cavity, the oil cover including a plurality of baffles on a bottom surface of the oil cavity, the baffles on one side of a longitudinal axis of the watercraft being skewed relative to the longitudinal axis and the baffles on the opposing side of the longitudinal axis being generally transverse to the longitudinal axis.

* * * * *